US009186905B2

(12) United States Patent
Toyosawa et al.

(10) Patent No.: US 9,186,905 B2
(45) Date of Patent: Nov. 17, 2015

(54) THICK FILM PRINT HEAD STRUCTURE AND CONTROL CIRCUIT

(75) Inventors: Takeshi Toyosawa, Houston, TX (US); Jiun-Chung Wang, Houston, TX (US); Chung I. Tan, Houston, TX (US)

(73) Assignee: Geospace Technologies, LP, Houston, TX (US)

( * ) Notice: Subject to any disclaimer, the term of this patent is extended or adjusted under 35 U.S.C. 154(b) by 104 days.

(21) Appl. No.: 13/481,546

(22) Filed: May 25, 2012

(65) Prior Publication Data

US 2013/0314473 A1 Nov. 28, 2013

(51) Int. Cl.
*B41J 2/14* (2006.01)
*B41J 2/335* (2006.01)
(Continued)

(52) U.S. Cl.
CPC ..... *B41J 2/3352* (2013.01); *B41J 2/345* (2013.01); *B41J 2/355* (2013.01)

(58) Field of Classification Search
USPC ..... 347/5, 12, 195, 180–182, 209–210, 9, 347/56, 61; 400/120.05
See application file for complete search history.

(56) References Cited

U.S. PATENT DOCUMENTS 3,938,136 A 2/1976 Kawakami
3,984,844 A 10/1976 Tanno et al.
4,032,925 A 6/1977 Kos
(Continued)

FOREIGN PATENT DOCUMENTS

JP 01130961 * 5/1989

OTHER PUBLICATIONS

Durbeck, et al., "Output Hardcopy Devices," Academic Press, 1988.
(Continued)

*Primary Examiner* — Lam Nguyen
(74) *Attorney, Agent, or Firm* — Andrews Kurth LLP

(57) ABSTRACT

A new structure (FIG. 11) for a thick-film thermal printhead and a variety of implementation approaches for controlling such a printhead. In the structure of the invention, the conductive lead at each end of the heater element is switched to either the power supply (Vhd) or ground, depending on the corresponding nib data bit. The improvement over a traditional center-tap structure (FIG. 1) is the reduction of density of conductive leads to achieve the resolution of printed dots. Compared to the printhead structure of alternated conductive system, either with diodes (FIG. 2) or without diodes (FIG. 4), which both suffer from the introduction of undesirable leaking currents, the printhead structure of the invention provides the advantage of eliminating leakage current completely. Control of the thermal printhead according to the invention is based on the sequential exclusive-OR (XOR) logic operation applied to the shifted-in nib data bit stream. The XOR functionality may be incorporated in the driver IC, embedded in the raster data processing FPGA (Field Programming Gate Array), or implemented in the form of a lookup table in the memory block of a main processor system. All prior art advanced controls based on a multi-pulse strategy can be applied directly from those used in prior art printhead structures to the controls for the thermal printhead for this invention without modification. A new driver IC (FIG. 26) is also disclosed according to the invention in which the outputs are SPDT (Single-Pole-Double-Throw) switches and the built-in XOR gates can be configured to act in the pass-through mode, if required, so that the new driver IC may be used as a traditional driver IC.

11 Claims, 18 Drawing Sheets

(51) Int. Cl.
*B41J 2/345* (2006.01)
*B41J 2/355* (2006.01)

(56) References Cited

U.S. PATENT DOCUMENTS

| | | | |
|---|---|---|---|
| 4,141,018 | A | 2/1979 | Mizuguchi et al. |
| 4,216,481 | A | 8/1980 | Hakoyama |
| 4,506,272 | A | 3/1985 | Arai |
| 5,134,425 | A | 7/1992 | Yeung |
| 5,255,011 | A | 10/1993 | Minowa et al. |
| 5,625,399 | A | 4/1997 | Wiklof et al. |
| 5,702,188 | A | 12/1997 | Watanabe et al. |
| 5,805,195 | A | 9/1998 | Smither et al. |
| 6,532,032 | B2 | 3/2003 | Dunham et al. |

OTHER PUBLICATIONS

Edwards, Steve, "Microprocessors of FPGAs?: Making the Right Choice," RTC Magazine. www.rtcmagazine.com/articles/print_article/102015. Apr. 12, 2011.

Tayosawa et al., "Development of Dual-Line Wide-Format 1200 dpi Thermal Printhead." Journal of Imaging Science and Technology, vol. 53, No. 9, Sep./Oct. 2009.

* cited by examiner

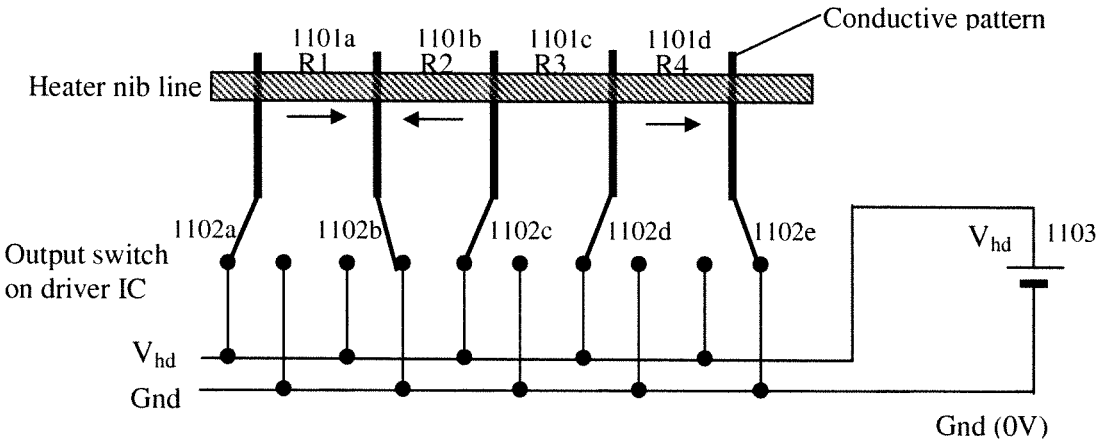
Fig. 11
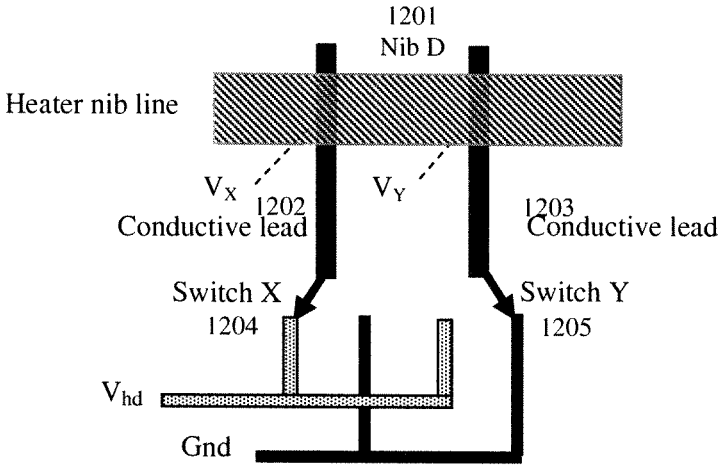
Fig. 12
X or Y =0 means switch X (1204) or Y (1205) is connected to Ground, i.e., $V_X$ or $V_Y$=0;
X or Y =1 means switch X or Y is connected to the power supply, i.e., $V_X$ or $V_Y$=$V_{hd}$.
X' and Y' are the inverse of X and Y, respectively.
D is the corresponding data bit of the single nib (1201).
1303
| X' | X | D | Y | Y' |
|---|---|---|---|---|
| 1 | 0 | 0 | 0 | 1 |
| 1 | 0 | 1 | 1 | 0 |
| 0 | 1 | 0 | 1 | 0 |
| 0 | 1 | 1 | 0 | 1 |
$Y = X \oplus D$ (1301)
$Y' = X' \oplus D$ (1302)
where $\oplus$ represents the exclusive-OR (XOR) function
Fig. 13

(Lookup table for $S_n = S_{n-1} \oplus r_n$, assuming $S_0=0$;
256 ($=2^8$) entries in total for 8 output switches)

2001

| Address (= raster data pattern: $r_8,\ldots,r_1$) | | | | | | | | Data (= switch output signals: $S_8,\ldots S_1$) | | | | | | | |
|---|---|---|---|---|---|---|---|---|---|---|---|---|---|---|---|
| $r_8$ | $r_7$ | $r_6$ | $r_5$ | $r_4$ | $r_3$ | $r_2$ | $r_1$ | $S_8$ | $S_7$ | $S_6$ | $S_5$ | $S_4$ | $S_3$ | $S_2$ | $S_1$ |
| **a7** | **a6** | **a5** | **a4** | **a3** | **a2** | **a1** | **a0** | **d7** | **d6** | **d5** | **d4** | **d3** | **d2** | **d1** | **d0** |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 1 | 1 | 1 | 1 | 1 | 1 | 1 | 1 | 1 |
| 0 | 0 | 0 | 0 | 0 | 0 | 1 | 0 | 1 | 1 | 1 | 1 | 1 | 1 | 1 | 0 |
| 0 | 0 | 0 | 0 | 0 | 1 | 0 | 0 | 1 | 1 | 1 | 1 | 1 | 1 | 0 | 0 |
| ... | | | | | | | | ... | | | | | | | |
| 1 | 1 | 1 | 1 | 1 | 1 | 0 | 0 | 0 | 1 | 0 | 1 | 0 | 1 | 0 | 0 |
| 1 | 1 | 1 | 1 | 1 | 1 | 0 | 1 | 1 | 0 | 1 | 0 | 1 | 0 | 1 | 1 |
| 1 | 1 | 1 | 1 | 1 | 1 | 1 | 0 | 1 | 0 | 1 | 0 | 1 | 0 | 1 | 0 |
| 1 | 1 | 1 | 1 | 1 | 1 | 1 | 1 | 0 | 1 | 0 | 1 | 0 | 1 | 0 | 1 |

THICK FILM PRINT HEAD STRUCTURE AND CONTROL CIRCUIT

BACKGROUND OF THE INVENTION

1. Field of the Invention

This invention concerns thick film print head apparatus and electronic control therefor and in particular to improvements for thermal recording on thick film. Still more particularly, the invention concerns a novel printhead structure and novel driver ICs (Integrated Circuit) with incorporation of a variety of control methods for recording and energy control.

2. Description of the Prior Art

Prior Printhead Structures

On a thermal printhead the heater nib line is made of an array of heater elements, on which Joule's heat is generated by applying a voltage across and flowing the current through the heater element. The traditional structure (Durbeck et al., "Output Hardcopy Devices," Academic Press, 1988) is shown in FIG. 1 where conductive paths are connected to both ends of each heater element, 0101*a*, . . . , 0101*e*, also denoted as resistive elements R1, . . . , R5, with the supply power supply $V_{hd}$ 0103. The resistive elements are called "nibs". A third conductive path is connected from the center of each heater element to a switch, 0102*a*, . . . , 0102*e*, usually embedded in a driver IC (Integrated Circuit) which is connected to ground.

The switch is turned on (0102*b*, 0102*e*) or off (0102*a*, 0102*c*, 0102*d*), depending on the corresponding nib's data bit being 1 or 0. The operation is quite straightforward—when the switch is on, electrical currents are flowing from both ends of a heater element towards the center of the heater element, and thereby Joule's heat is generated on the heated nibs 0101*b*, 0101*e*. Hence this structure is referred to as a "center-tap" arrangement. There are two drawbacks to this arrangement, however. First, the density of the conductive pattern is twice the resolution of the printed dots. Second, each printed dot may be of an undesirable butterfly-like shape. This is because usually high electrically conductive material such as gold is used as the electrodes on a thick film thermal head and, due to high thermal conductivity of gold, heat escapes from the conductive pattern in the center portion toward the electrodes, resulting in lower temperature than other parts of the heater element.

One way to reduce the density of the conductive pattern and also to eliminate the undesirable butterfly-like dot shape is to provide an alternated conductive lead system. A simplified circuit diagram of such a system (Tanno et al., U.S. Pat. No. 3,984,844, 10/1976; Mizuguchi et al., U.S. Pat. No. 4,141,018, 2/1979) is shown in FIG. 2 where the nominal resistance of each heater element (i.e., nib) is denoted as R. The addition of diodes 0204 in the upstream conductive path 0203 prevents the leakage current from reverse-flowing. Each nib of the heater nib line 0205 is turned on or off, by a switching circuit 0206 embedded in a driver IC, depending on the raster data bit being 1 or 0 associated with a specific nib. The downstream switches 0206 and the upstream conductive circuits 0203 are shared by pairs of neighboring nibs. When the external controller sends raster data to the register in the driver IC, the power supply 0207 is connected to the conductive path A 0201, termed "A-phase," or path B 0202, termed "B-phase," alternatively. In this kind of configuration the density of conductive pattern is the same as the resolution of printed dots. However, there exists undesirable leakage current. For example, while the current flowing through the supposedly energized nib 0208 is V/R as designed, the leakage current flowing through the three neighboring nibs 0209, 0210, 0211 on the left side is V/(3R), thereby generating ⅓ of Joule's heat as of that on the energized nib 0208.

For high-resolution thermal heads, the space allowed for mounting diode arrays becomes constrained. Consequently, a deep diffusion zone is required during the semiconductor manufacturing process. Therefore, adding diode arrays as in FIG. 2 presents problems in technical implementation as well as an increase in manufacturing cost. Another thermal printhead development has focused on removing the diodes and adding a secondary power supply (Kos, U.S. Pat. No. 4,032,925, 6/1977; Yeung, U.S. Pat. No. 5,134,425, 7/1992; Watanabe et al., U.S. Pat. No. 5,702,188, 12/1997; Smither et al., U.S. Pat. No. 5,805,195, 9/1998). FIG. 3 shows such an arrangement for a diode-less alternated conductive lead system, where $V_P$ is the voltage from a primary power supply and $V_S$ ($<V_P$) is applied from a secondary power supply. In the example, a single switch 0303 is turned on for heating nib R8, and switches 0301 and 0302 are turned on for heating nibs R3 and R4.

If all the nibs are of the same resistance value (nominal R), $I_E=V_P/R$ is the current designed to flow through each nib to be heated (R3, R4 and R8), $I_N=V_S/R$ is the current through the neighbor nibs (R2, R5 and R9), and $I_O=(V_P-V_S)/(2R)$ is the current through all the other nibs (R1, R6, R7, R10, R11, R12, . . . ), as described in a published paper (Toyosawa et al., "Development of dual-line wide-format 1200-dpi thermal printhead," Journal of Imaging Science and Technology (JIST), vol. 53, no. 9, September/October 2009). If $V_S$ is selected to be of ⅓ of $V_P$, as shown in FIG. 4, all the nibs which are not to be energized intentionally would have the same parasitic current as ⅓ of the full current and an undesirable Joule's heat of ⅓ of the full-power on the energized nibs (R3, R4 and R8), no matter what data pattern is applied on the driver ICs.

In most thermal printing applications, on paper or film, ⅓ of full power is below the threshold of the energy curve for activating a heater element (nib) to mark a visible dot on the media, thus no spurious printing would result. However, the undesirable residual heat of ⅓ full power may pose a problem for certain applications. For example, in DTS (Direct-To-Screen) thermal systems, images are to be printed on a screen by transferring heat from the thermal head to a ribbon and then to the top emulsion of the screen. A successful complete DTS job requires a clean and sharp peel-off of the unheated ribbon from the screen, but the residual heat generated by ⅓ of full power may raise the temperature in the unprinted ribbon area, resulting in a sticky image edge and an unclean peel-off.

The issue of the undesirable residual heat generated by the leakage current can be examined by looking at the voltage difference across a single nib heater element 0501, as shown in FIG. 5 where the upstream conductive lead 0502 is usually connected to a power supply (i.e., $V_U=V_{hd}$) and the downstream conductive lead 0503 to a driver IC. In the desirable condition, when the data bit corresponding to the nib is 1, the switch on the driver IC is enabled and the downstream lead is connected to ground so that $V_D=0$.

However, when the data bit is 0, the switch on the driver IC is disabled (i.e., open) and the downstream lead "floats". The values of $V_U$ and $V_D$ vary, depending on the printhead circuitry structure and the location of the supposedly unheated nib. For example, in alternated conductive lead system with diodes, as shown in FIG. 2, when the switch for a downstream lead is open, there are three possible cases: a) $V_U=V_D=V$, b) $V_U=V$, $V_D=⅔V$, or c) $V_U=⅓V$, $V_D=⅔V$. In the two latter cases a leakage current and undesirable heat are generated. Similarly, in a diode-less alternated conductive lead system (FIG. 3) assuming $V_S=V_P/3$, when the switch for a downstream lead is open, it could be a) $V_U=V_P$, $V_D=(V_P-V_S)/2=V_P/3$, or b) $V_U=V_S$, $V_D=(V_P-V_S)/2=V_P/3$. In both cases a leakage current and undesirable heat are generated.

Prior Driver ICs

The prior art block diagram of FIG. 6 is for a typical off-the-shelf 64-bit driver IC 0601 comprising a shift register 0602, latches 0603 and gated switches 0604. IC 0601 reads the raster data into the SerialIn port, shifts the data bit by bit, and after all the data bits have been shifted in, enables the latch and strobe signals so that all the output switches 0604 are turned on or off according to the raster data pattern. The output ports DO1 . . . DO64 are connected to the downstream conductive lead 0503 (see FIG. 5) of each nib on the heater nib line. Therefore for the nib bit designated as 1, the gated switches of FIGS. 2 and 4 are on, the downstream conductive lead is connected to ground, the current flows through the corresponding nib and Joule's heat is generated. The timing diagram of control and data signals for the diode-less alternated conductive lead system is shown in FIG. 7 along with the switching timing of the power supplies $V_P$ and $V_S$ ($=V_P/3$) for A-phase and B-phase.

For real system implementation, a driver IC can accommodate only a limited number of parallel outputs and switches. Hence multiple driver ICs are used. Usually a full scanline of raster data are fed into a raster data processing FPGA (Field Programming Gate Array) which splits a full scanline into multiple bit streams of short length equal to the data width of the driver IC. The FPGA then sends these in-parallel bit streams simultaneously along with a set of control signals (Clock, Latch, Strobe, etc.) to the driver ICs. FIG. 8 is a block diagram 0801 for such a prior art arrangement utilizing multiple 256-bit driver ICs 0804*a*, 0804*b* of which the structure is similar to the 64-bit driver IC 0601 of FIG. 6. One advantage of the structure (FIG. 8) of multiple in-parallel bit streams is the increase of printing speed, because the processing time is only limited by the data width of driver ICs. For example, when 256-bit driver ICs are used, it takes only 256 clocks to shift a full scanline of raster data and load into the heater nib line 0802. During the time period of data shifting and loading, the raster data processing FPGA 0803 may also simultaneously accomplish tasks of data sorting and bit stream splitting for the next scanline.

In the alternated conductive system, either with diodes (FIG. 2) or without diodes (FIG. 4), conductive leads to the power supply are usually connected to the opposite side to those connected to the driver ICs. This symmetric structure of conductive leads is more suitable for flat-type printheads, but may make manufacturing of edge or near-edge type thermal heads more inconvenient.

Prior Printhead Energy Control Methods

An imperative requirement for thermal printing is to have a consistent and uniform dot shape across the whole printed image. One affecting factor is the temperature of the printhead because the thermal head gets warmed up and the dot size grows bigger as the printing continues, due to the nature of heat dissipation and accumulation on the nib line. To ensure that the heated nibs have the same dot size during the cold-start period (i.e., beginning of printing) as in the steady-state period (i.e., after getting warmed up and the thermal head stays at a constant temperature), two approaches of energy adjustment based on thermistor readings have been used. One method is to adjust the voltage level of the power supply which provides the current for heating the nibs. Usually it is done by the main processor which adjusts the power supply through remote control signals. This is shown in FIG. 9 which is a block diagram of a printer system utilizing a thermal head, with the motion mechanism and corresponding motion controller omitted for clarity of illustration. The other approach is to apply additional small pulses to the nibs, thus generating more heat, during the cold-start period.

The most important factors affecting the consistence and uniformity of dot shape are the residual heat of the nib due to heating in the previous data line as well as the heat transfer from the neighbor nibs due to leakage current. To compensate for such effects (which are the characteristics of the thermal head), a multi-pulse control strategy, commonly known as history control or hysteresis control, is usually adopted. It appends a number of small pulses, following the main pulse (corresponding to nib data's being 1), to the driver IC so that additional current is applied to the nib. The control pattern, i.e., the number of those small pulses and the pulse width, depends on the historical data (i.e., nib data of previous lines) as well as the data pattern of neighbor nibs.

FIG. 10A is an example timing diagram illustrating that each nib receives one main voltage pulse 1001 corresponding to the raster data bit being 1 or 0, three small pulses 1002, 1003, 1004 for hysteresis control and two small pulses 1005, 1006 for temperature compensation. The implementation of multi-pulse control usually resides in the raster data processing FPGA which sends the data bit streams of a full scanline one by one for the pulse train. FIG. 10B illustrates that the sequence of sending the bit streams 1012, . . . , 1016 for pulses used in hysteresis control and temperature compensation are essentially the same as the bit stream 1011 for the main pulses.

3. Identification of Objects of the Invention

A primary object of the invention is to provide a new structure for a thick film printhead.

Another object of the invention is to provide a new driver IC as well as a variety of control methods for the new thick-film printhead identified above Another object is to provide an assembly wiring structure so that all conductive leads are on the same side of the nib line in the new printhead identified above.

SUMMARY OF THE INVENTION

The invention is embodied in a new structure for thick-film thermal printhead, and a variety of implementation approaches for controlling the printhead. In the new structure, the conductive lead at each end of each heater element is connected to either the power supply or ground, depending on the corresponding nib data bit, via an output switch embedded in a driver IC. The improvement over the traditional center-tap structure is the reduction of density of conductive leads by half. Although printhead structures of an alternated conductive system, either with diodes or without diodes, make the same improvement in reducing the density of conductive leads, they suffer from the introduction of undesirable leaking current. The advantage of a new arrangement according to the invention is to eliminate the leakage current completely.

Controlling the thermal printhead in the new structure is based on a sequential exclusive-OR (XOR) logic operation applied to the shifted-in nib data bit stream. The XOR functionality may be embedded in the driver IC 1401 (FIG. 14), incorporated in the raster data processing FPGA 1801 (FIG. 18), or implemented in the form of lookup table in the memory block of a main processor system (FIGS. 20, 21, 22, 23, 24, 25). All advanced controls based on multi-pulse strategy, such as temperature compensation, history (hysteresis) control, black-rate control, ENM (Enhanced Nib Management) control, etc., can be applied directly from those used in conventional printhead structures to the new structure of this invention without modification. Since the printhead structure of the invention is of the same conductive pattern density as the prior printhead structure using the diode-less alternated conductive lead system, it can also adopt the same dual-line approach for the design of a high-resolution thermal head.

Also provided in the invention is a new driver IC 2601 (FIG. 26) in which the outputs are SPDT (Single-Pole-Double-Throw) switches and the built-in XOR gates can be configured to act in the pass-through mode, if required, so that the new driver IC may also be used as a traditional driver IC for printhead structures of alternated conductive system as well as for thin-film printheads.

Another aspect of the invention is that all the conductive leads are on the same side of the nib line of the printhead. This feature is beneficial in the space budget and material cost, and thus is more suitable for manufacturing an edge or near-edge type printhead.

BRIEF DESCRIPTION OF THE DRAWINGS

FIG. 11 shows a new printhead arrangement according to the invention.

FIG. 12 shows the connection for a single nib in a thermal head structure in FIG. 11.

FIG. 13 illustrates a truth table and its equivalent logic functions for the structure of FIG. 12.

DESCRIPTION OF PREFERRED EMBODIMENTS OF THE INVENTION

Printhead Structure with XOR-logic Control

A circuit arrangement for a thick-film thermal printhead illustrated in FIG. 11 is provided according to one aspect of the invention which eliminates the undesirable leakage current and residual heat on the nib as described above for prior printhead structures. In the new structure, the conductive lead at each end of each heater element 1101*a*, 1101*b*, . . . 1101*d* is connected to either the power supply $V_{hd}$ 1103 or ground Gnd (0V) via an output switch 1102*a*, 1102*b*, 1102*e* where the switches are provided in a driver integrated circuit (IC) and are turned on/off, depending on a corresponding nib data bit. The printhead structure of FIG. 11 reduces the density of conductive leads by one-half, as in the prior art arrangement of FIGS. 2 and 4, and eliminates leakage current completely as compared to the arrangement FIGS. 2 and 4.

Figure 5:
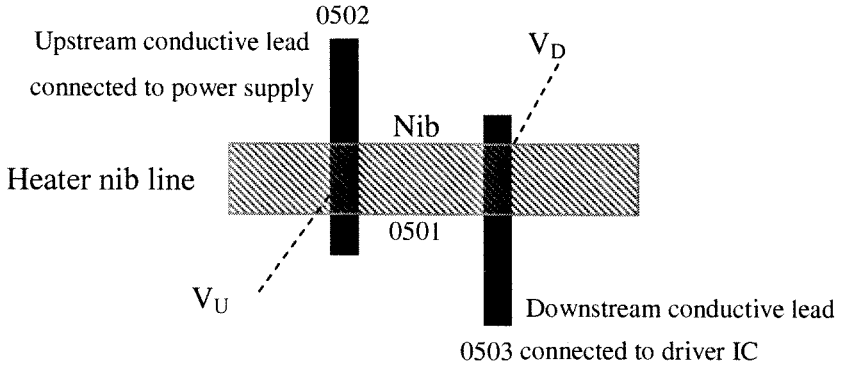
Fig. 5 (PRIOR ART)
FIG. 5 shows the connection for a single nib of the prior art printhead structure.

FIGS. 12 and 13 illustrate the connection for a single nib of the printhead structure of FIG. 11, with exclusive-OR (XOR) logic for printhead control. In the arrangement of FIG. 12, the conductive leads 1202, 1203 at each end of the nib element 1201 may be connected through electronic switches 1204, 1205 to either the power supply $V_{hd}$ or ground Gnd, depending on the corresponding data bit, so that the nondeterministic condition for the case of a data bit being 0 in the conventional thermal head structure (FIG. 5) is eliminated. The truth table for the desired switch X 1204 and Y 1205 positions, given the data bit D for a single nib 1201, is shown in FIG. 13. For each case of the data bit D being 0 or 1, there are two possible combinations: for D=0, it could be X=0, Y=0, or X=1, Y=1; for D=1, it could be X=0, Y=1, or

X=1, Y=0.

To control the heating of a nib line, one switch position of the leftmost (or rightmost) nib needs to be fixed (by connecting to the power supply or ground) and, once fixed, it determines the unique position of the other switch (right or left) which then serves as a fixed switch (left or right) for the adjacent nib. Following the similar procedure, once one switch for each of the next nibs is decided, given the desirable nib data bit, the position for the other switch can be determined. Therefore, given the data bits for the full nib scanline, all the switch positions can be determined uniquely by using the truth table 1303 of FIG. 13 repeatedly and sequentially for each nib one by one as follows:

Assuming the left switch, X, for a nib has been decided, with a given data bit D, the right switch, Y, can be determined by using the truth table 1303 which may be expressed as an exclusive-OR logic function 1301 in FIG. 13. The relationship between Y' (inverse of Y) and the inputs X' (inverse of X) and D is also an exclusive-OR logic function 1302, and is used in the control implementation to be described below for other embodiments.

XOR-logic Incorporated in a Driver IC

Figure 6:
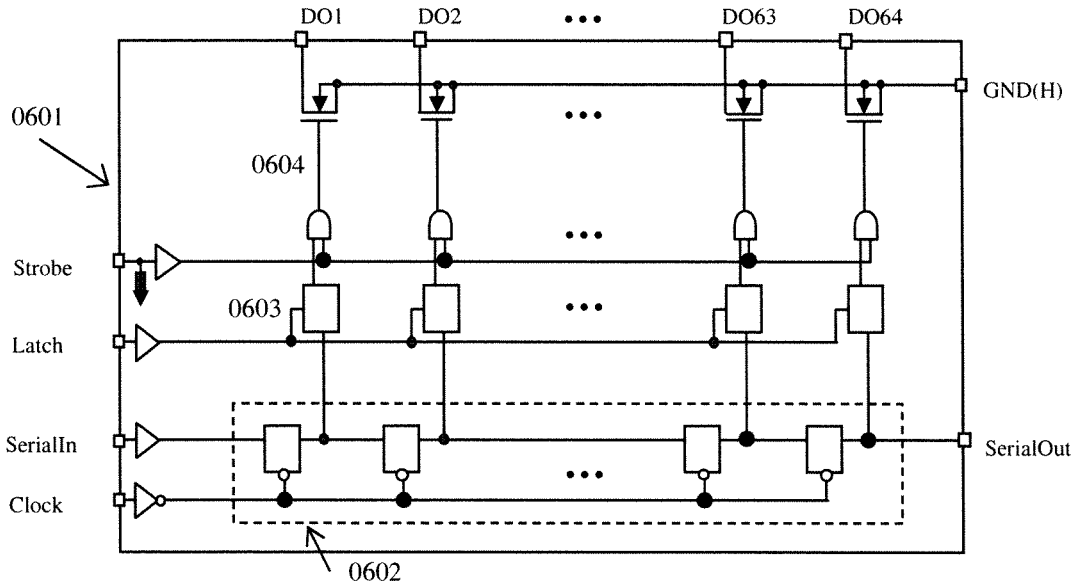
Fig. 6 (PRIOR ART)
FIG. 6 is the block diagram for a prior art 64-bit traditional driver IC for thermal printheads.
Figure 7:
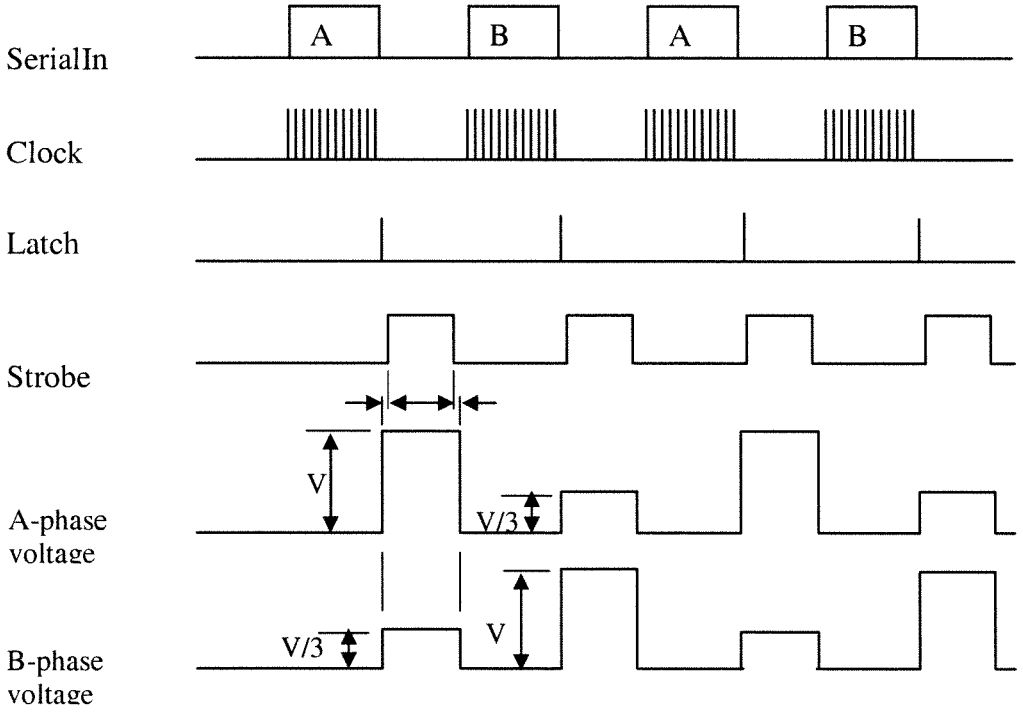
Fig. 7 (PRIOR ART)
FIG. 7 is a timing diagram of the control and data signals for the prior art driver IC of FIG. 6 and the switching timing of the power supplies for A-phase and B-phase.
Figure 14:
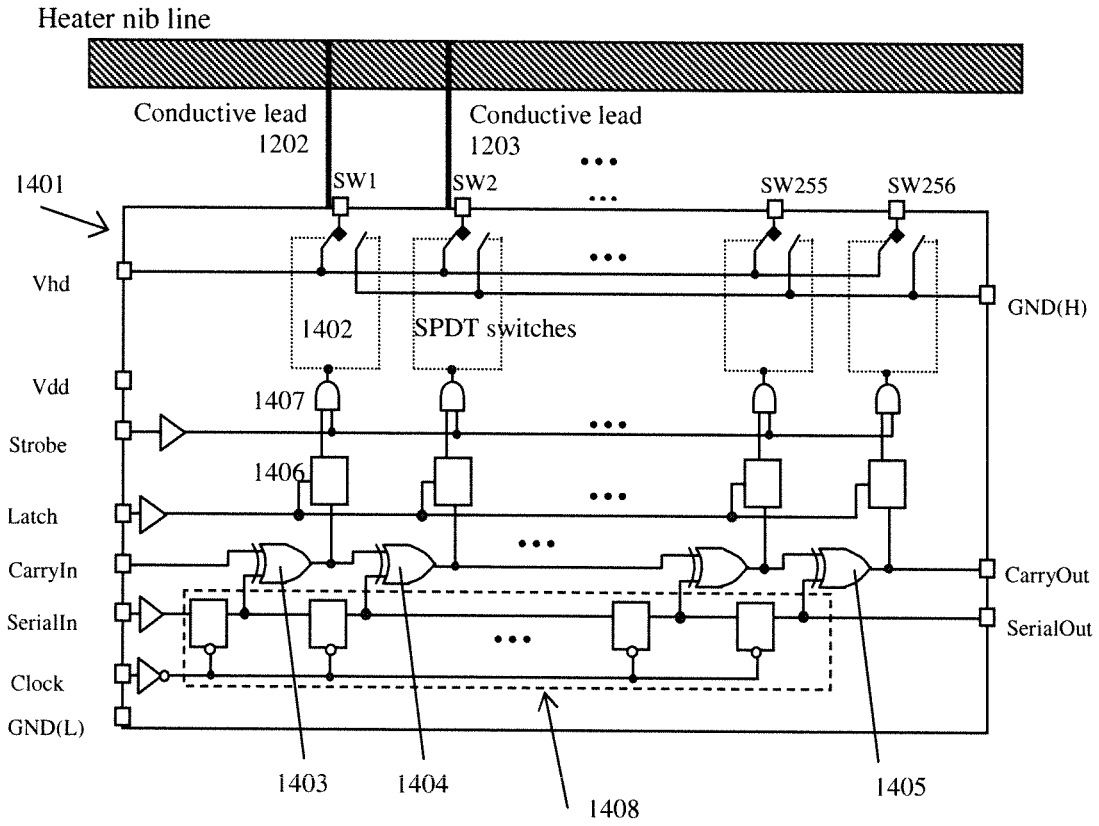
FIG. 14 is a block diagram of a driver IC with built-in XOR logic gates and SPDT switch outputs.

Another aspect of the invention is to add the XOR function 1301 of FIG. 13 into a traditional driver IC 0601 of FIG. 6. The schematic diagram of such a custom 256-bit driver IC 1401 is shown in FIG. 14 where an XOR gate 1403, 1404, 1405 is inserted for use by each nib and an SPDT (Single-Pole-Double-Throw) switch 1402 at output (SW1, SW2 . . . SW256) is used for connection to the conductive path 1202, 1203 of the nib. One of the two inputs of said XOR gate 1404 is the shifted-out data bit (D) which is read into the driver IC sequentially through the SerialIn (S-In) port; the other is the output of the previous XOR gate 1403, i.e., X input of current XOR gate 1404 is Y output of the preceding XOR gate 1403.

Figure 15:
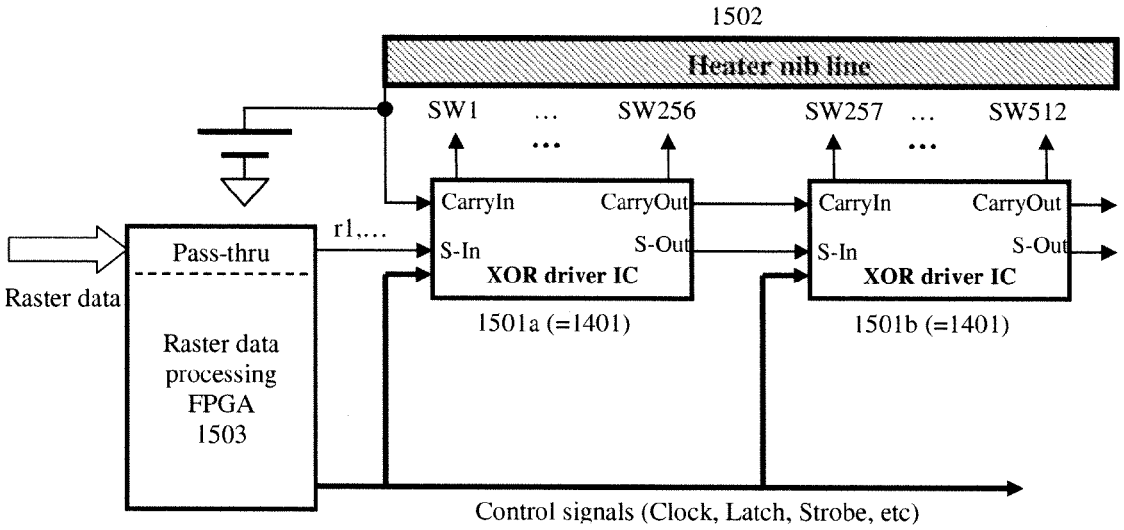
FIG. 15 illustrates an arrangement of cascading built-in XOR driver ICs for the thermal head structure.

One possible configuration for a cascaded connection is shown in FIG. 15 where 256-bit XOR drivers ICs 1401 (of FIG. 14) are used for illustration. On each driver IC 1501*a*, 1502*b* there are a cascade input, CarryIn, for the very first XOR gate 1403, and a cascade out, CarryOut, from the very last XOR gate 1405 (FIG. 14). The leftmost conductive path of the heater nib line 1502 is fixed by connecting to ground, so is the CarryIn port of the first driver IC 1501*a*.

The configuration of cascading SerialIn/SerialOut S-In/S-Out and CarryIn/CarryOut is essentially the same as a fictitious big driver IC that has a shift register of the same depth as the length of the raster scanline. In applications where the printing speed is of uttermost concern, this configuration may not be practical. Consider a nominal 54" (actual length=53.76") 600 dpi printhead, which has a full scanline of 32,256 nibs, as an example. No matter whether 64-bit or 256-bit driver ICs are used, in the cascaded configuration it takes at least 32,256 clocks to shift in a full scanline for converting and outputting the switch data bits. The clock frequency of a driver IC usually is in the order of MHz, which means even for a max of 10 MHz, it takes at least 3.3 msec to have all the switch bits ready for heating a heater nib line. The time estimated here is just for shifting only the main pulse (corresponding to the raw raster data bit), not including those additional pulses used for hysteresis control and temperature compensation, etc. Those additional pulses should follow the main pulse and also be shifted in the driver ICs. Thus the total time required for each scanline will be much longer. This could make meeting the requirement of high printing speed difficult.

Figure 16:
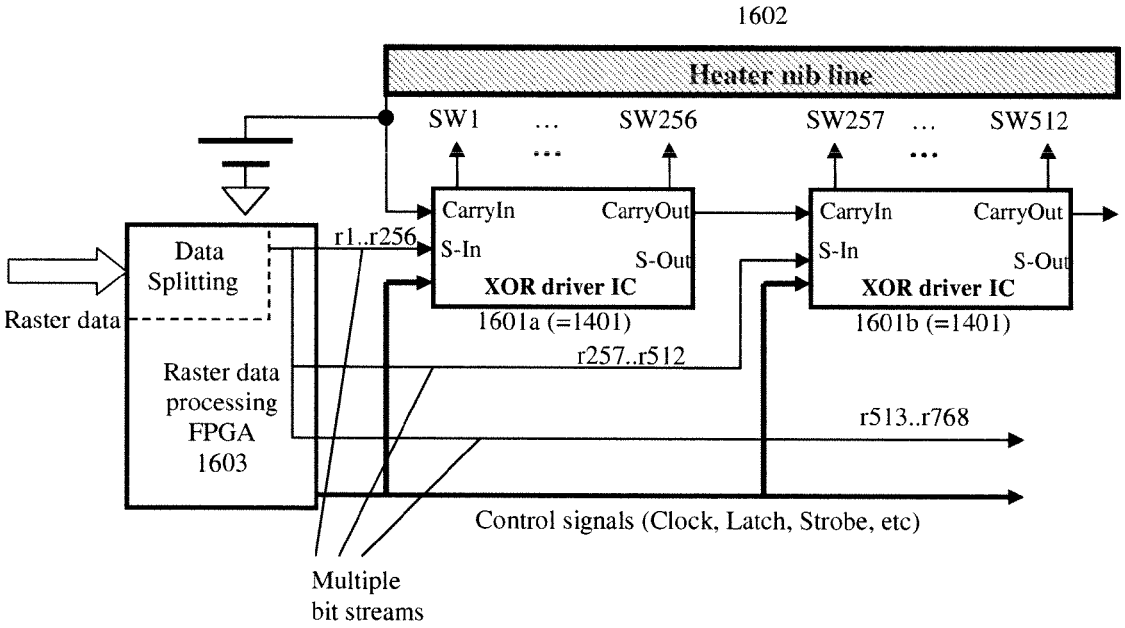
FIG. 16 illustrates another arrangement of cascading (only CarryIn/CarryOut) built-in-XOR driver ICs for the thermal head structure.

Another configuration for cascading the XOR driver ICs 1401 is shown in FIG. 16 where only CarryIn/CarryOut signals are cascaded while SerialIn/SerialOut S-In/S-Out signals are not. To increase printing speed by reducing the data shifting time, raster data of one full scanline are split into multiple bit streams which are fed into the SerialIn port of each driver IC 1601*a*, 1601*b*. There is a constraint in this configuration, however. The second bit stream (r257 . . . r512) cannot start feeding into the second driver IC 1601*b* at the same instant as the first one does, because the first XOR gate 1403 (FIG. 14) on 1601*b* for r257 needs to wait until a valid output from the XOR gate 1405 (FIG. 14) on 1601*a* for r256 is ready. Therefore, the raster data processing FPGA 1603 is programmed to hold all the other bit streams while busy outputting the first bit stream (r1 . . . r256) to the first driver IC 1601*a*. Only after 256 clocks that the first bit stream is completed, can the FPGA 1603 then start outputting the second bit stream, (r257 . . . r512). This is because now the CarryOut on the first driver IC 1601*a* is a valid value for r256 and can be fed into CarryIn of the second driver IC 1601*b* for XORing with r257. The process of 256-clock delay is repeated sequentially for all other driver ICs. Only after all the bit streams have been processed one by one sequentially on all driver ICs, can the FPGA 1603 start applying the control signals, LATCH and STROBE, to heat the full nib line. In such cascaded configuration with multiple bit streams, it is essentially the same as outputting a single bit stream of full scanline with SerialIn/SerialOut (S-In/S-Out) cascaded altogether on all driver ICs as in FIG. 15. It means the use of multiple in-parallel bit streams with XOR driver ICs does not reduce the data shifting time and no gain is earned. This shortcoming leads to other embodiments described below.

XOR-logic Incorporated in Raster Data Processing FPGA

Figure 8:
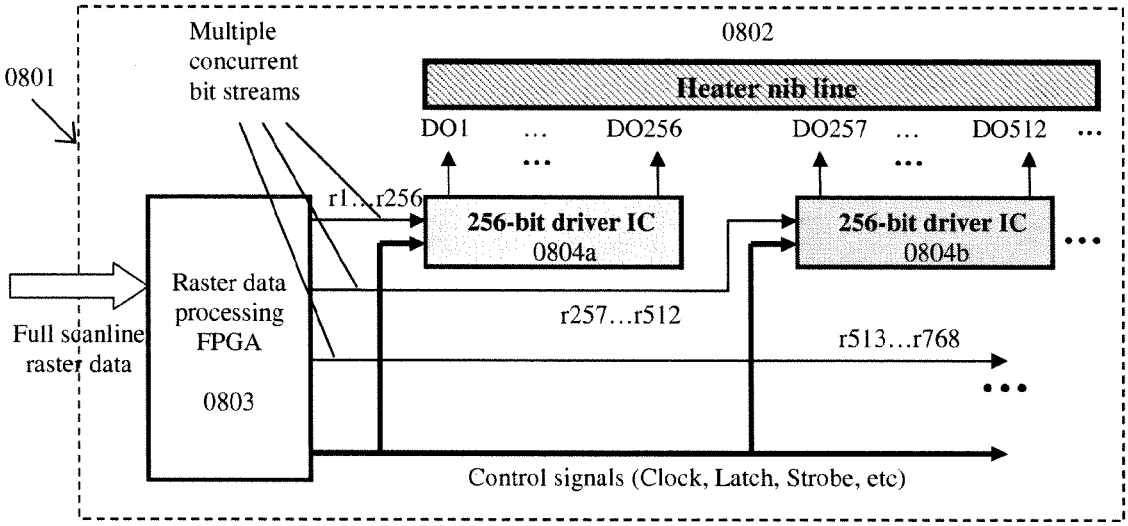
Fig. 8 (PRIOR ART)
FIG. 8 illustrates a prior art implementation of multiple driver ICs in real printing applications.
Figure 9:
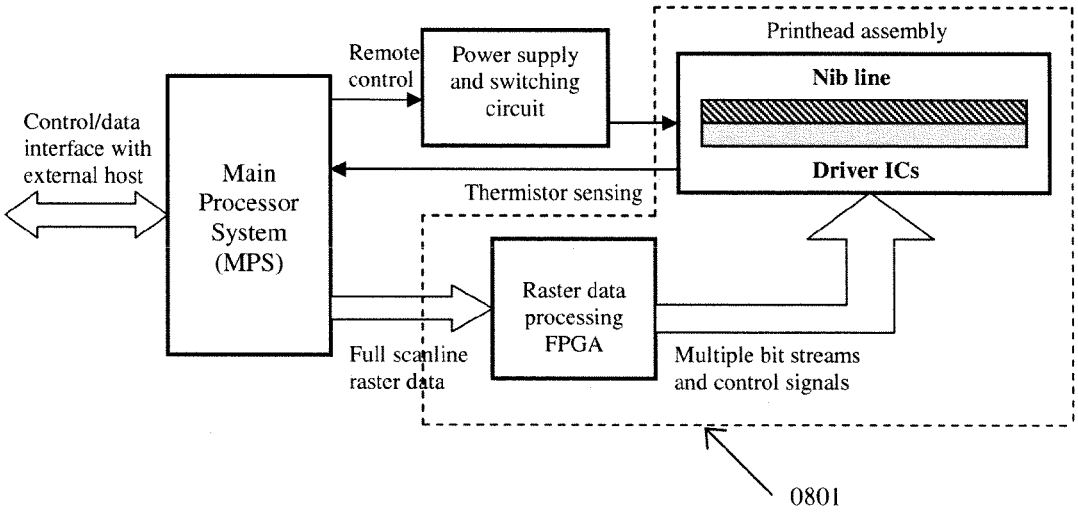
Fig. 9 (PRIOR ART)
FIG. 9 is the block diagram of a prior art thermal printer system, without the inclusion of a motion mechanism and a motion controller.
Figure 10A:
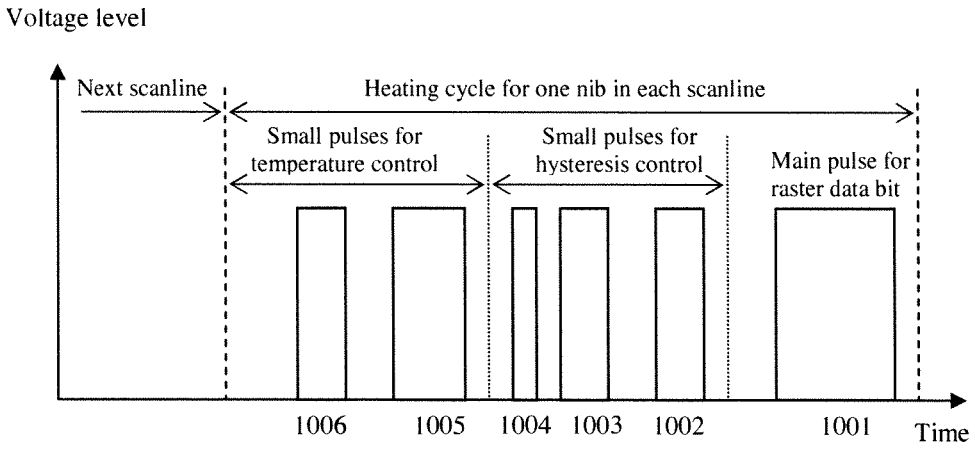
Fig. 10A (PRIOR ART)
FIG. 10A is a typical timing diagram during the heating cycle on a single nib for a prior art implementation of multi-pulse control.
Figure 10B:
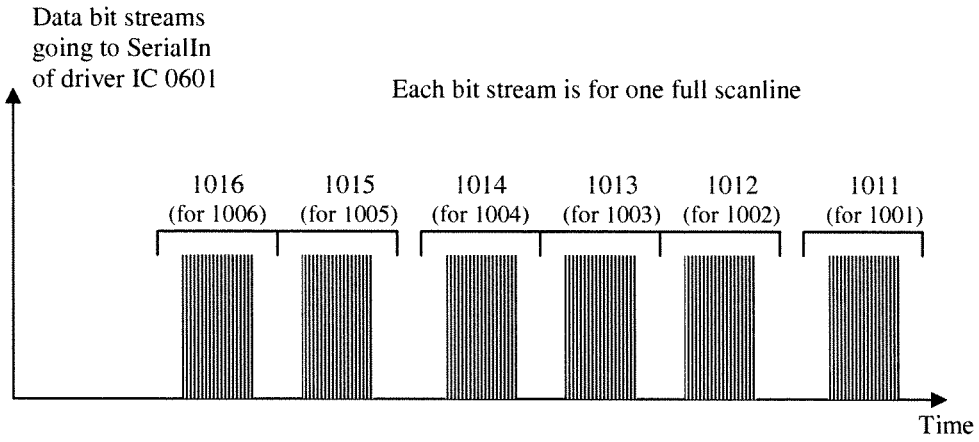
Fig. 10B (PRIOR ART)
FIG. 10B illustrates the sequence of data bit streams sent by the raster data processing FPGA to the driver ICs for a prior art implementation of multi-pulse control.
Figure 17:
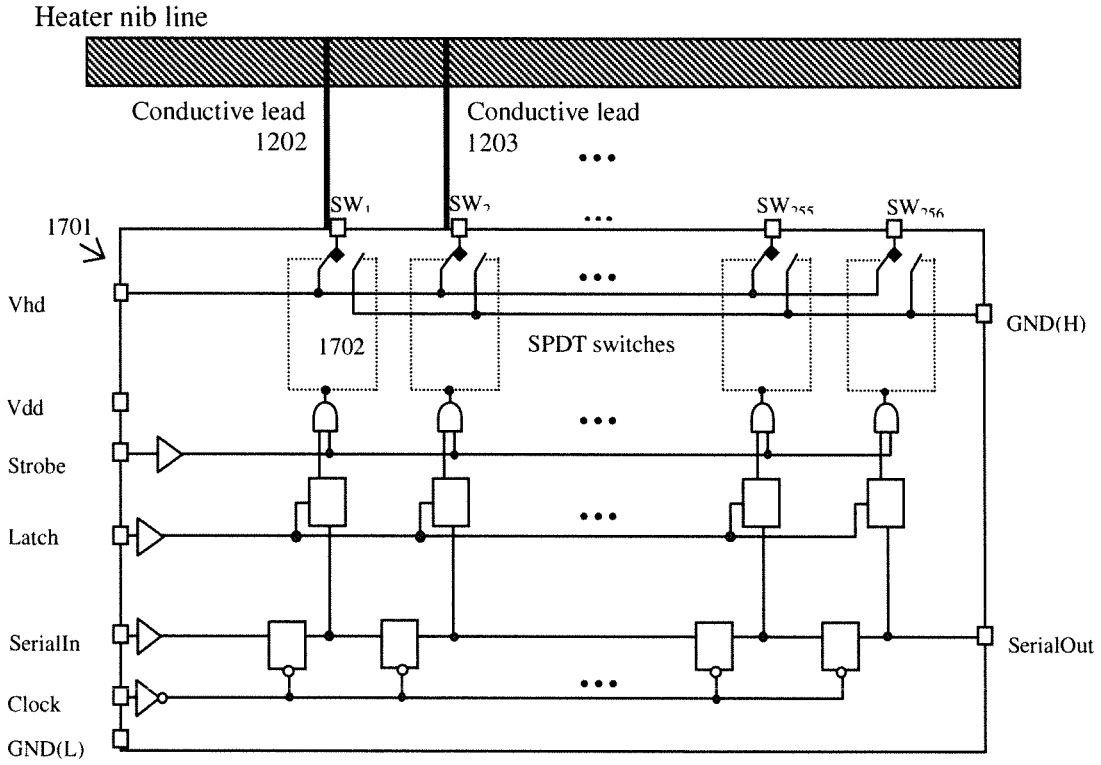
FIG. 17 is a block diagram of a driver IC with modification from the traditional driver IC, with only SPDT output switches added.
Figure 18:
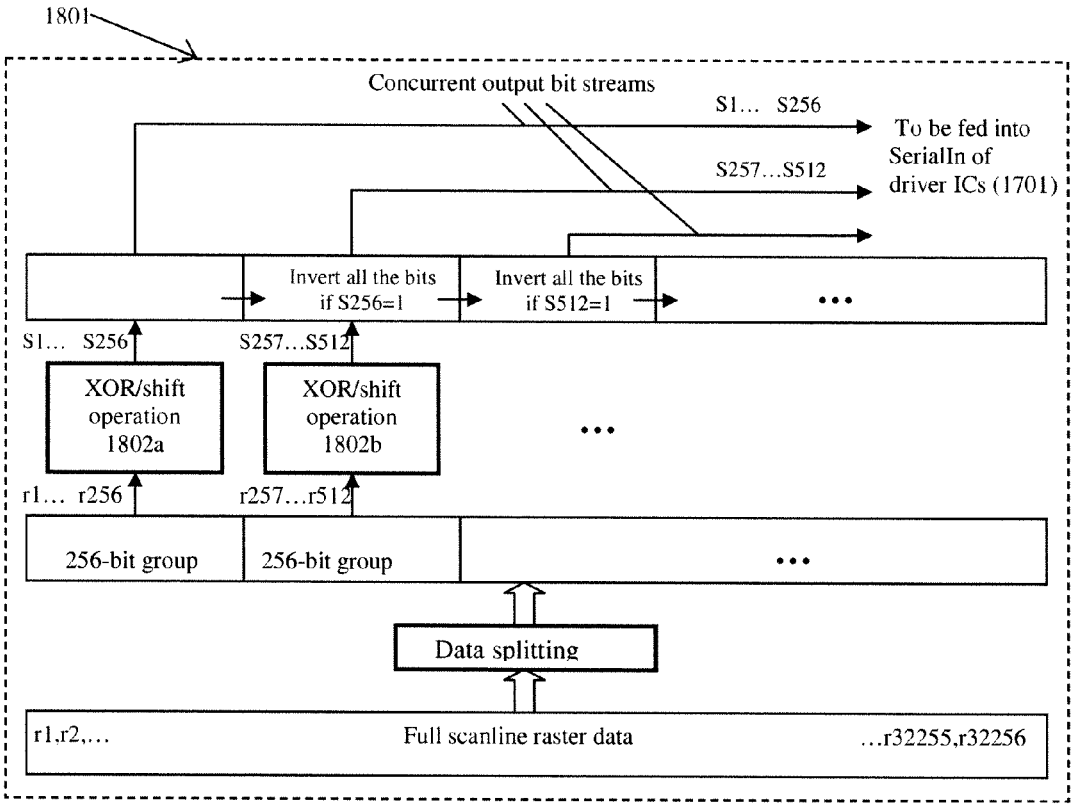
FIG. 18 is a flow diagram illustrating the XOR and shifting operations for concurrent multiple bit streams inside the raster data processing FPGA.
Figure 19:
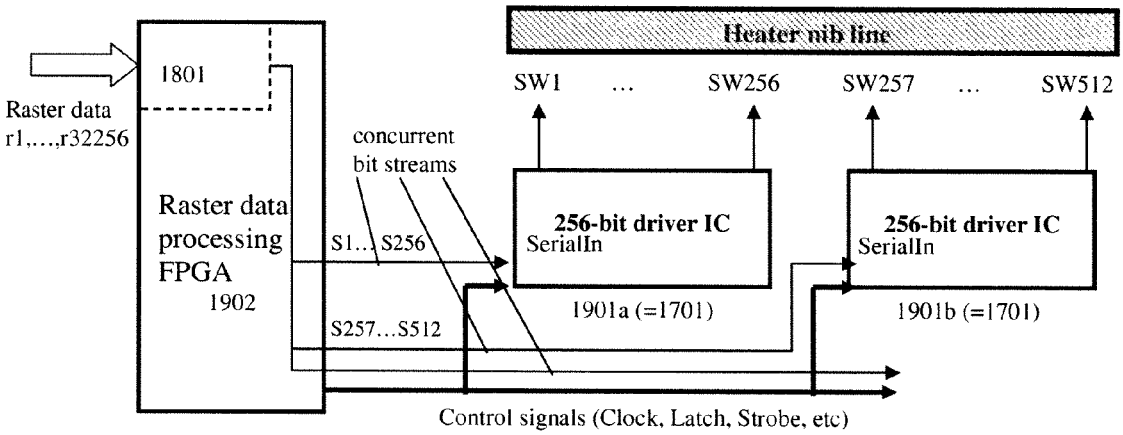
FIG. 19 is a block diagram of a printing system for the printhead structure of the invention where the XOR function of FIG. 18 is performed inside the FPGA.

Another arrangement is to use a slightly modified driver IC 1701 as shown in FIG. 17 which is almost the same as the traditional prior art driver IC 0601 of FIG. 6 except SPDT (Single-Pole-Double-Throw) switches 1702 are used at the output end for connection to the conductive path (1202, 1203) of the nib line. The goal is to increase printing speed by reducing the data shifting time through the use of multiple in-parallel bit streams (similar to the conventional case as shown in FIG. 8). The essence of this arrangement is to migrate the task of data conversion (via XOR logic) to the raster data processing FPGA as shown in FIG. 18. The operation of the arrangement 1801 of FIG. 18 inside the FPGA is described below.

a. Split raster data of one full scanline, r1 . . . r32256, into 256-bit groups as (r1 . . . r256), (r257 . . . r512), . . .
b. Apply each 256-bit group through a function module, 1802*a*, 1802*b*, for concurrent XOR/shift operation, with all the 126 (=32256/256) groups carried out simultaneously, assuming the leftmost bit of each group are all 0's, i.e., S0=S256=S512= . . . =0
c. From logic functions 1301 and 1302 of FIG. 13, the right-side switch output signal Y based on a left-side switch output signal X should be inverted if the original X is inverted. This means that Y257 (in the $2^{nd}$ group) based on the assumption of X257=Y256=0 (Y256 in the $1^{st}$ group) should be inverted if the real Y256 is 1. Since Y257 is inverted, so will Y258. Similarly for all the other XOR outputs, Y259, . . . Y512. Therefore, if the real S256 (=Y256) obtained in step b is 1, then all the bits in the group S257 . . . S512 are inverted.
d. If the real bit S512 obtained in step c is 1, then all the bits in the next group S513 . . . S768 are inverted.
e. The above "invert if necessary" operation is repeated until the end of the scanline is reached.
f. Output these bit streams concurrently to the SerialIn input of the driver ICs 1901*a*, 1901*b*, as shown in FIG. 19.

The concurrent XOR/shift operation in step b takes 256 FPGA clocks for all the 256-bit groups and it functions the same as in an XOR driver IC 1401 in FIG. 15 or 16 except that now the XOR operation is implemented inside FPGA 1902 instead of the driver IC. The extra computations required are the XOR/shift operations (concurrently for all the 256-bit groups, 256 FPGA clocks for each group) and the "invert if necessary" operation on a 256-bit data group, each taking only several (assuming max 10 for illustration) FPGA clocks. The operation of inversion cannot be done concurrently on all the groups; instead, it can only be performed sequentially because each group needs to wait until the "invert if necessary" operation of the preceding group is completed to decide that an inversion is required. There are 126 groups, so the extra time, in terms of FPGA clocks, spent on this approach is the sum of 256 (for step b) and 10×126 (steps c, d and e). Including a minor overhead (such as steps a and f), the extra time should be no more than 2,560 FPGA clocks. FPGA's clock frequency is usually at least one order of magnitude (i.e., 10 times), and sometimes two orders, higher than driver IC's. As a result, the extra time spent by FPGA should be no more than the time for shifting data on the driver IC 1701 in FIG. 17.

This approach of implementing XOR function inside FPGA is essentially similar to the one in FIG. 16, with the addition of the "invert if necessary" logic (using an inverse XOR function, for example.) The most tedious operation in FIG. 16, however, is to perform the sequential inversion on each driver IC, and the true penalty is that additional control lines may be needed for synchronizing the sequence. Besides, an additional 126 clocks (of driver ICs), one for inverting each driver IC, are required. It's obviously clear that the approach of implementing XOR-logic inside FPGA offers the advantage of flexibility without complicating the hardware in the driver IC and sacrificing the data processing time and thus the printing speed.

XOR-logic Incorporated in Main Processor

Figure 1:
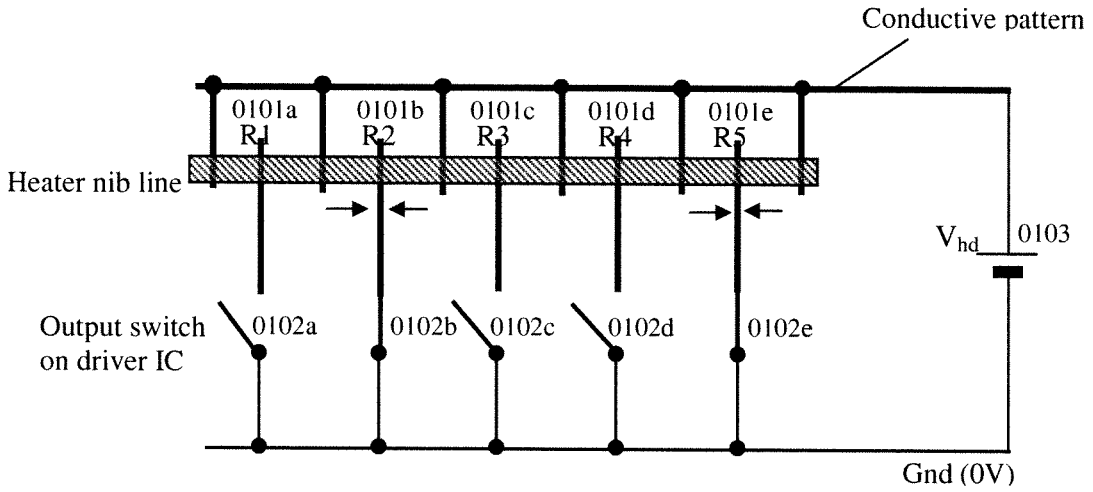
Fig. 1 (PRIOR ART)
FIG. 1 shows the structure of a prior art thick-film center-tap thermal printhead.
Figure 2:
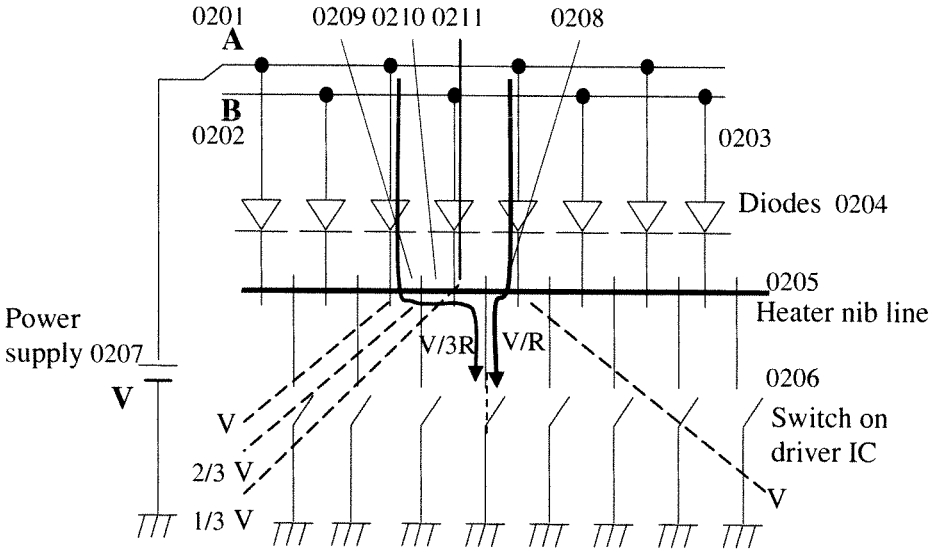
Fig. 2 (PRIOR ART)
FIG. 2 is a simplified circuit diagram of a prior art alternated conductive lead system with diodes, illustrating undesirable leakage current.
Figure 3:
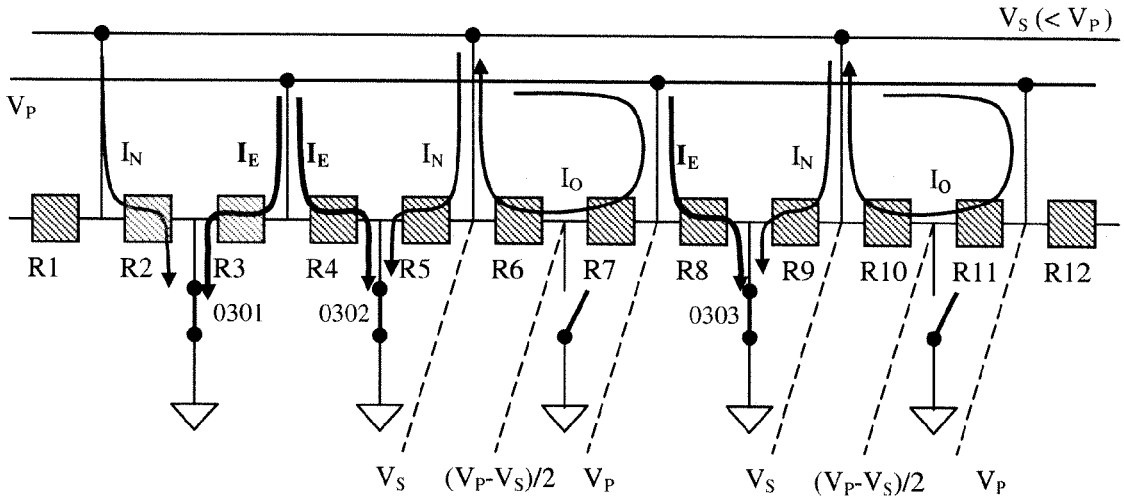
Fig. 3 (PRIOR ART)
FIG. 3 illustrates the undesirable leakage current in a prior art diode-less alternated conductive lead system.
Figure 4:
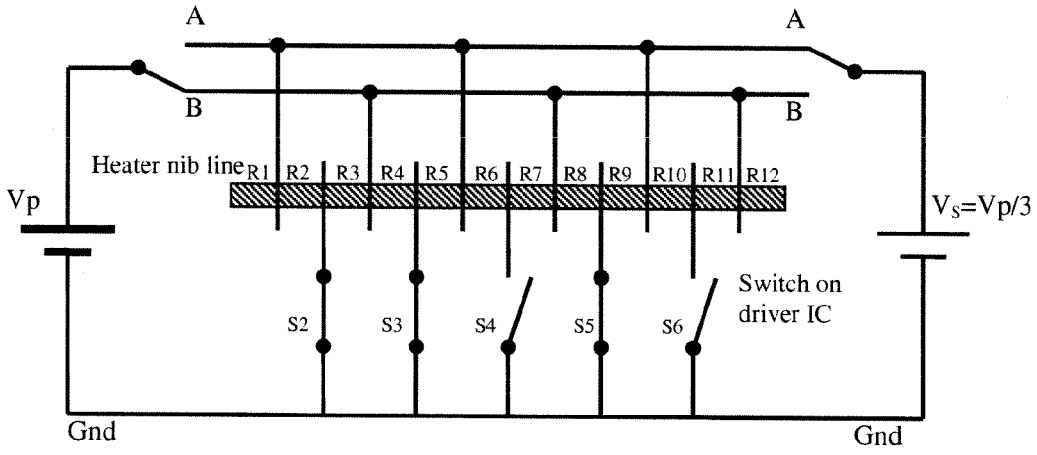
Fig. 4 (PRIOR ART)
FIG. 4 is a simplified circuit diagram of the prior art diode-less alternated conductive lead system of FIG. 3.

The main difference between the conventional printhead structure of FIG. 1, 2 or 4 and the one proposed of FIG. 11 is as follows. In the former case the desired nib data can be fed into off-the-shelf driver ICs in a straight-forward way, either in a single bit stream or in multiple bit streams. In the latter case, due to the requirement that the output of the driver ICs be the appropriate control signals (instead of nib data) for the switches, data conversion using XOR gates must be implemented. Moreover, if using multiple driver ICs for in-parallel bit streams, an XOR driver IC 1401 of FIG. 14 must be used, or a combination of XOR and the "invert if necessary" functions may be migrated to the raster data processing FPGA (FIGS. 18, 19) while using a slightly modified driver IC 1701, FIG. 17. Another embodiment of the invention is to port these functions to the main processor system as illustrated below.

Figures 20, 21:
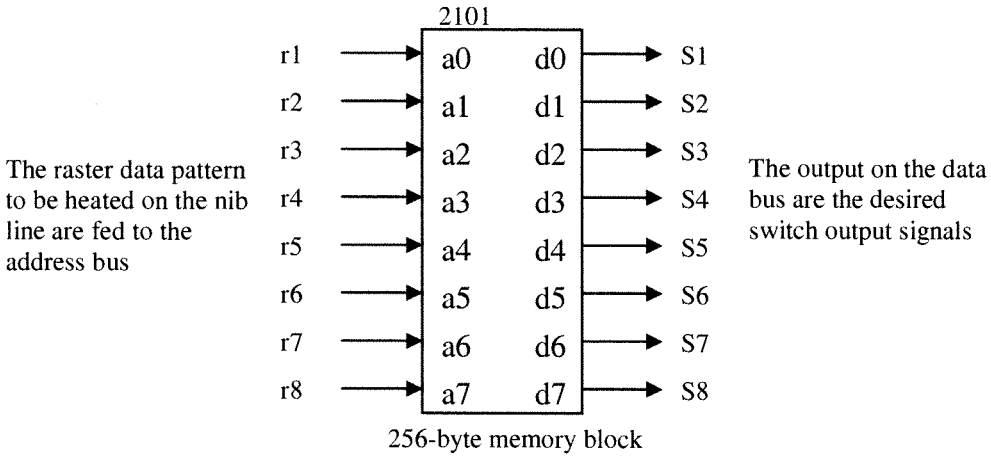
FIG. 20 is a truth table for the 8-bit output switch data S1 . . . S8 by applying the XOR function 1301 to nib data patterns r1 . . . r8.
FIG. 21 illustrates an 8-bit address by 8-bit data memory block to implement the lookup table 2001 of FIG. 20.

For data conversion from the raster nib data to the switch output signals, the XOR function 1301 (FIG. 13) may be implemented more efficiently, from a processing speed point of view, by using a lookup table. Consider a simple case of a scanline of only 8 nibs. Given the desirable raster data for the nib line, r1 . . . r8, it is necessary to determine the appropriate control signals for all of the 8 switches, S1 . . . S8. Assume that the leftmost switch is fixed by connecting it to ground, i.e., S0=0. Based on the XOR function 1301, the 256 combinations of S1 . . . S8 for all the possible nib data patterns can be set up in a truth table 2001 as shown in FIG. 20. The 256-byte table can be stored in a lookup table as an 8-bit address by 8-bit data memory block 2101 as shown in FIG. 21. Given a specific nib data pattern, the main processor system can look up the appropriate switch data S1 . . . S8 by feeding the nib data, r1 . . . r8 to the address bus for the memory location. The switch data S1 . . . S8 will appear on the data bus and then be fed into the SerialIn port of the driver IC 1701 FIG. 17 which does data shifting, latching and strobing in a conventional way.

Extending the structure of an 8×8 look-up table 2001, in practical applications a 16×16 lookup table can be used. Though a bigger memory block ($2^{16}$×2 bytes=128 Kbyte) is required, it is only a small fraction of memory provided in most main processor systems, and the advantages gained can be illustrated in the timing analysis shown below.

Figure 22:
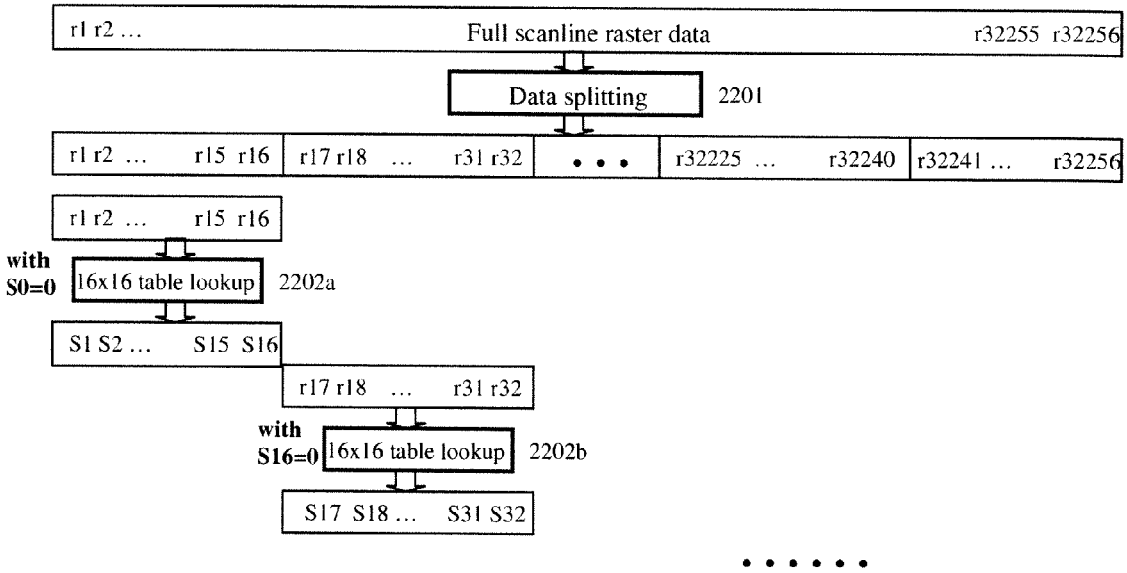
FIG. 22 illustrates data-splitting and table lookup operations in the microprocessor system to compute the appropriate switch data from a given raster data array.
Figure 23:
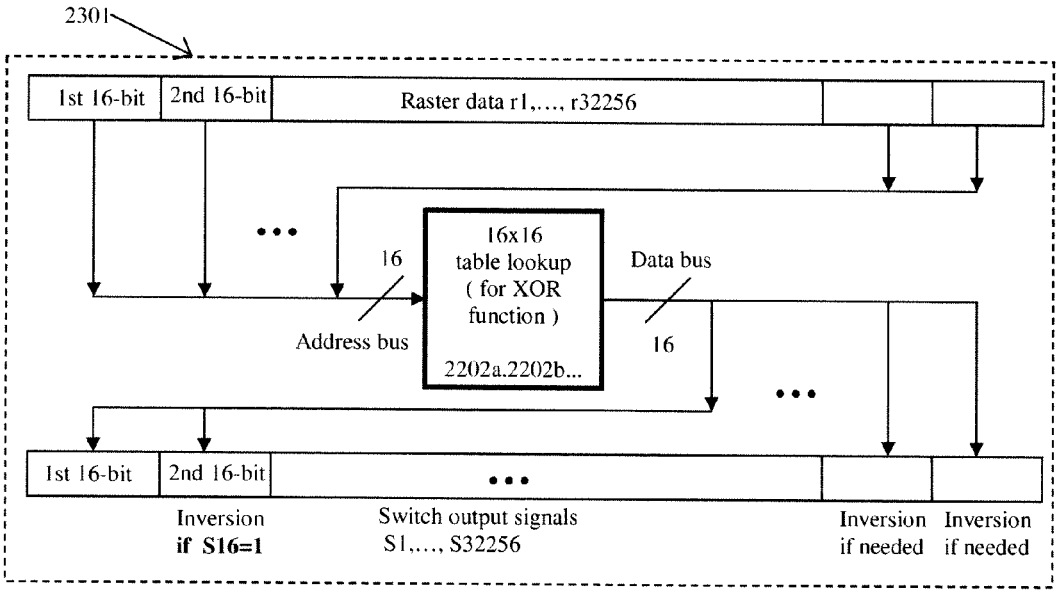
FIG. 23 illustrates the complete operation in the microprocessor system to compute the switch data from a given raster data array.

Using a nominal 54" 600 dpi printhead as an example, the operations in the microprocessor system to compute the appropriate switch data S1 . . . S32256 from a given raster data array of r1 . . . r32256, are shown in FIGS. 22 and 23.

a. The data array of r1 . . . r32256 is split into groups of 16-bit data arrays with r1 . . . r16 as the $1^{st}$ one, r17 . . . r32 as the $2^{nd}$ one, and so on.
b. For the first group, bits r1 . . . r16, are used as the indexing address to find the switch output signals, S1 . . . S16, from the lookup table, with S0=0.
c. For the next group, bits r17 . . . r32, are used as the indexing address to find the switch output signals, S17 . . . S32, from the lookup table assuming S16=0.
d. If the real S16 obtained in step b is 1, then all the bits in S17 . . . S32 found in step c (which is based on S16=0) are inverted.
e. The steps c and d are repeated for the rest of nib line as shown in FIG. 23 until the end of the scanline.
f. The bit stream, S1 . . . S32256, of a full scanline is sent to the FPGA.

Figure 24:
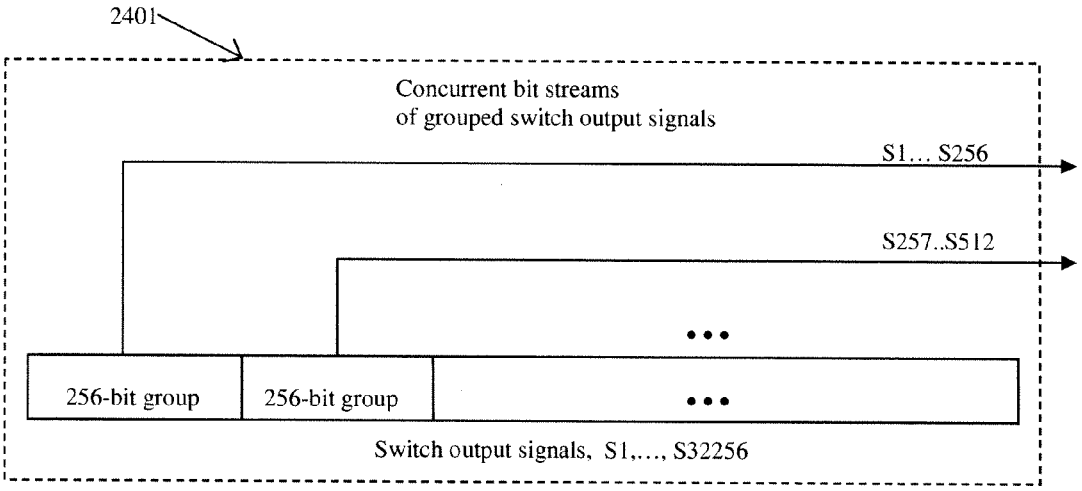
FIG. 24 shows data-splitting and concurrent sending operations by the raster data processing FPGA after receiving a full scanline of switch data from the microprocessor system.
Figure 25:
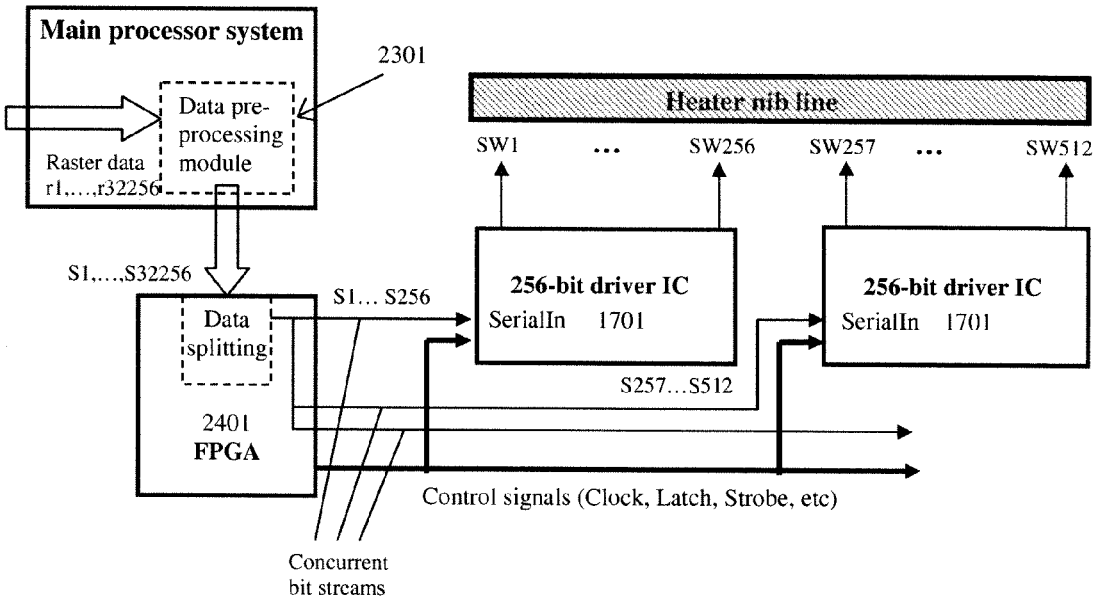
FIG. 25 is a block diagram of a printing system for the proposed printhead structure where the XOR function is performed using table lookup in the microprocessor system.

The FPGA then splits the complete bit stream, S1 . . . S32256, into multiple smaller ones of the same length as the data width of the driver ICs (256 bits, in this example, FIG. 24) and outputs these bit streams concurrently to the SerialIn input of the driver ICs 1701, as shown in FIG. 25.

The computation time used by the processor can be estimated as follows. There are 32256/16=2016 group operations, each taking two basic ones: table lookup and inversion of a 16-bit number. Each basic operation needs several CPU clocks, depending on the architecture of the processor. Usually the clock frequency of processor used in the main processor system is at least two orders higher than driver IC's or one order higher than FPGA's. Therefore, the computation overhead is about the same as FPGA's. However, this method offers the advantage in flexibility, since it is implemented in software and can be modified easily.

A General-purpose Driver IC

In all the above arrangements of the invention, prior art driver ICs 0601 (FIG. 6) cannot be used, because they have the switch output connected to ground when enabled, or stay open when disabled, i.e., behaving as an SPST (Single-Pole-Single-Throw) switch. In all the embodiments of the invention, the desirable driver IC should have the switch output connected to a power supply when enabled, or to ground when disabled, acting as an SPDT (Single-Pole-Double-Throw) switch. Besides, depending on the requirements of printing speed and space budget on the printhead assembly, the option of including XOR gates in the driver IC should be considered. For example, in the configuration of using a single bit stream where CarryOut/CarryIn and SerialOut/SerialIn S-In/S-Out signals are cascaded between two consecutive driver ICs 1501*a*, 1501*b* (FIG. 15), the XOR gates should be incorporated within the driver IC. On the other hand, in the configuration of multiple bit streams without cascading driver ICs, the XOR function may be implemented in the raster data processing FPGA 1801 in 1902 (FIG. 19) or in the main processor system 2301, in FIG. 25. As a result, the XOR gates are not needed in the driver IC 1701 (FIG. 17).

Figure 26:
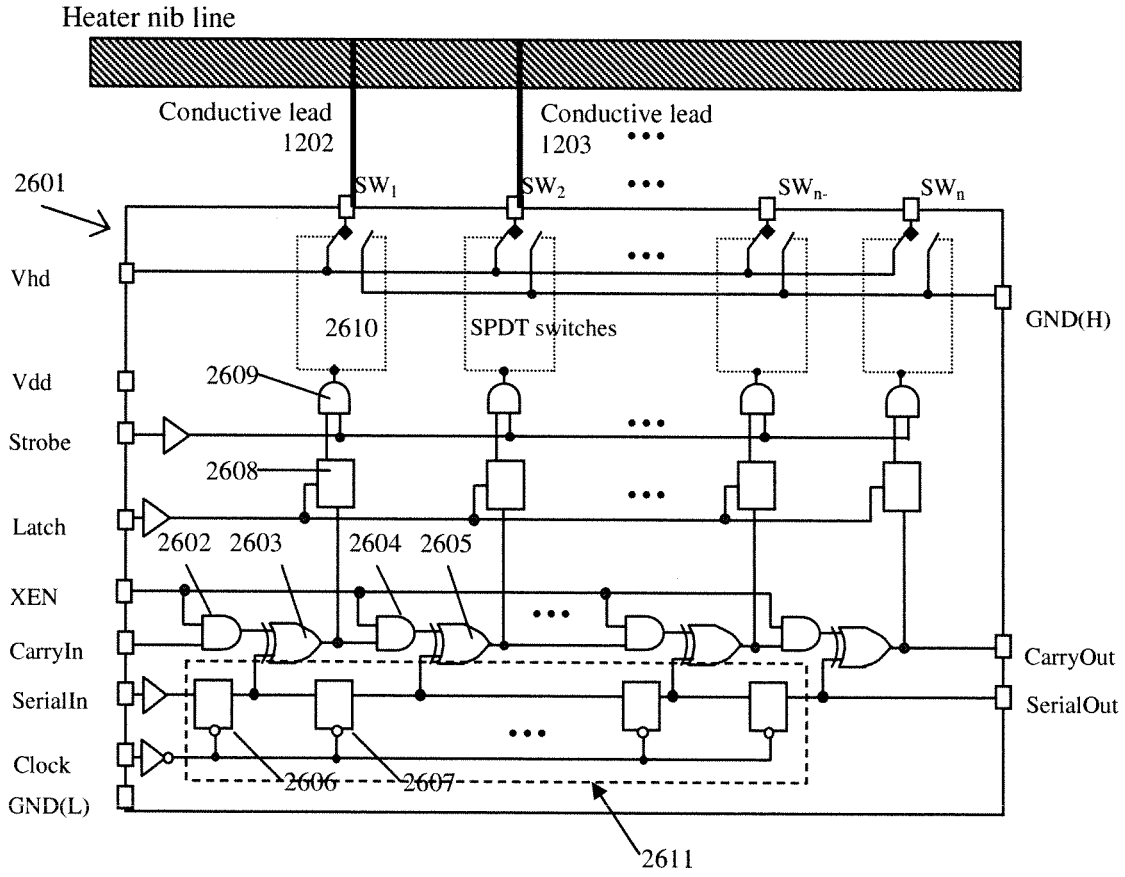
FIG. 26 is a block diagram of a proposed general purpose driver IC according to the invention.

In light of this flexible requirement, another embodiment of the invention is a general purpose driver IC 2601, as shown in FIG. 26, where XEN (XOR Enable) is the external input signal for enabling/disabling the built-in XOR function. When XEN=1, the output of the 1$^{st}$ AND gate 2602, to be fed into the 1$^{st}$ XOR gate 2603, is the CarryIn signal; for other AND gates 2604, the output, which is to be fed into the XOR gate 2605 that follows, is the same as the output of the preceding XOR gate 2603. In this arrangement, the circuit behaves as the driver IC 1401 in FIG. 14. When XEN=0, the output of the AND gate 2602, 2604 is always 0, and the output of the XOR gate 2603, 2605 is the same as the output on the D flip-flop 2606, 2607 of the shift register, the shifted-in bit coming from the SerialIn signal. Thus the XOR function is virtually nonexistent as in the driver IC 1701 (FIG. 17). Furthermore, when XEN=0 and only the ground of the output SPDT is connected, it can be used as a replacement for the traditional driver IC 0601 (FIG. 6).

Advanced Controls of Thermal Head

Three embodiments for the implementation of XOR-logic data conversion (from raster data to nib switch output signals) have been illustrated above. One is in the driver IC when the use of single raster bit stream is appropriate. Two others take advantage of concurrent multiple bit streams. One is in the raster data processing FPGA; a second is in the main processor system. In the case of FPGA, XOR-logic is implemented in multiple XOR logic modules, one for each bit stream. In the case of main processor system, a lookup table stored in a memory block is used to replace and speed up the XOR logic operations.

No matter which of the three embodiments is used, it has no major affect on the advanced controls for temperature compensation and history (hysteresis) control mentioned before, which are based on multi-pulse strategy. This is because each small pulse, be it part of history control or temperature compensation, in the pulse train can be treated as a raster data bit similar to the leading main pulse. Those supplemental raster data bit streams representing the small control pulses are then sent to the driver IC similar to the main bit stream. As a consequence, well-established advanced controls can work with the new thermal head and the XOR-logic implementation without any modification.

Other advanced controls, such as black-rate and ENM (Enhanced Nib Management), can also work the same way without any modification. The concept of black-rate control is described, for example, in (Hakoyama, U.S. Pat. No. 4,216,481, 8/1980). It takes into account the influence of power supply capacity on the current flowing through the nibs. Due to a limited capacity of power supply, the current flowing on each nib varies, depending on the total number of nibs to be energized, and thus affects the heating and the dot size. To compensate for such variation while processing raster data, the FPGA counts the number of nibs of which the data bit is 1 and divides by the total number of nibs of one full scanline to calculate the black rate. Based on the calculated black rate, the FPGA may feed supplemental pulses in the pulse train to the XOR-logic conversion module and then to the driver ICs.

ENM control originated from NRC (Nib Resistance Compensation) control which seeks to compensate for the resistance variations in individual nibs. The idea is that for a nib of higher resistance, a higher voltage is required to produce the same heat dissipation ($=V^2/R$) as compared to other nibs of lower resistance. The implementation is, instead of increasing the magnitude of voltage, to feed supplemental pulses for all the nibs, with weight of those pulses based on the measured nib resistances. The ultimate goal of image quality control is to achieve consistency and uniformity of dot size for all the nibs. However, NRC control may not be sufficient to achieve this goal, because the image quality also depends on mechanical environment such as the contact pressure between the thermal head and the platen as well as platen roughness. Therefore, ENM control adopts the following procedure: a) apply a fixed pulse train to all the nibs to print a test image, b) scan the printed image and obtain the optical density (as a measurement of dot size) of individual nibs, and c) based on the variations in the result obtained in b), compute the appropriate supplemental pulses for each nib. The control pattern for those appropriate supplemental pulses are downloaded to and stored in the raster data processing FPGA. During printing, the FPGA retrieves the control pattern of those supplemental pulses and appends them to the pulse train which is to be sent to the XOR-logic conversion module and then to the driver ICs. The details of control strategy, such as control sequence, number of pulses and pulse widths, etc., depends on the printhead characteristics and printing applications.

Figure 27A:
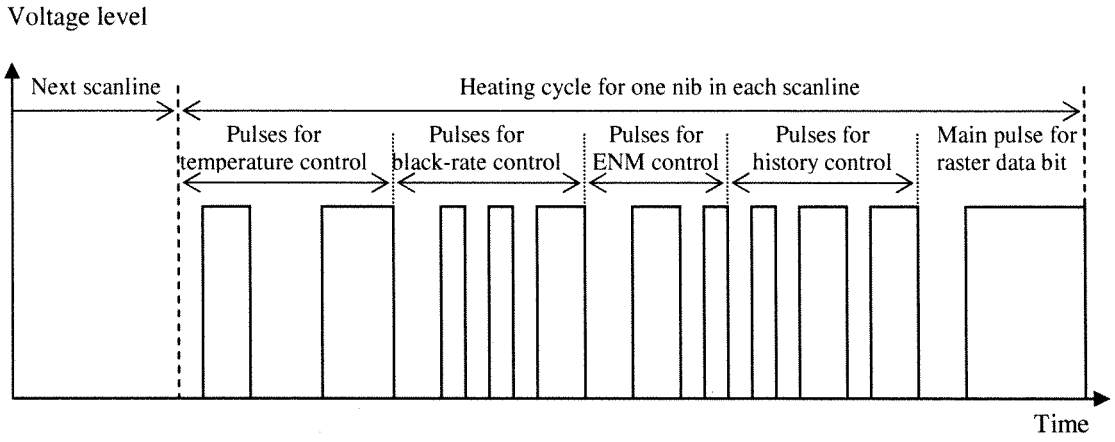
FIG. 27A is a typical timing diagram during the heating cycle on a single nib for advanced control implementation of multi-pulse control.
Figure 27B:
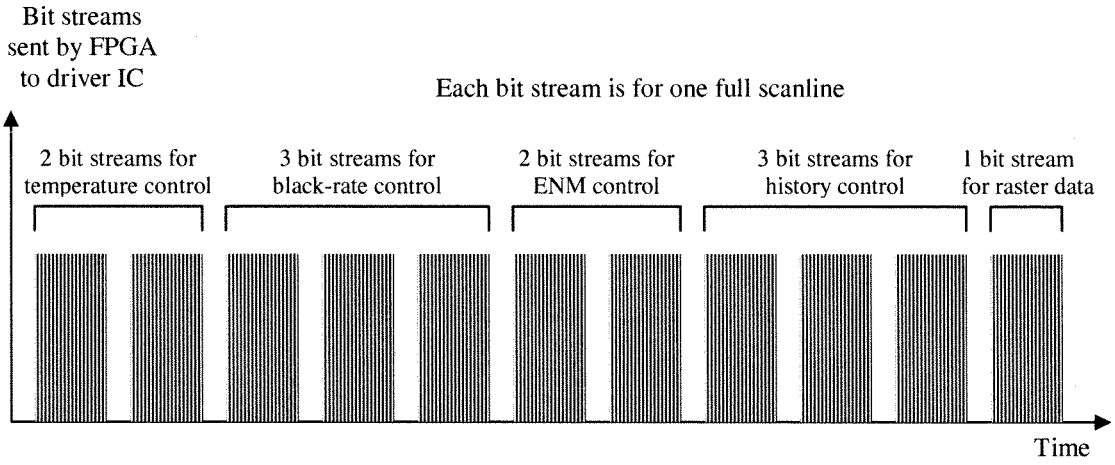
FIG. 27B illustrates the sequence of bit streams sent by the raster data processing FPGA to the driver ICs for advanced control implementation of multi-pulse control.

In real implementation, the whole pulse train for each nib is composed of the main pulse representing the raster data bit and the supplemental pulses for temperature compensation, history (hysteresis) control, black-rate control and ENM. In conventional conductive lead systems, each pulse, be it the main one or the supplemental, is like a raster data bit from the driver IC point of view. Similarly, in the new printhead structure of FIGS. 11 and 12 described above, although the extra XOR-logic module is implemented in the driver IC, the raster data processing FPGA, or the main processor system, each pulse in the pulse train is treated as a raster data bit. Therefore, advanced control methods described here may still be applied without sacrificing any functionality. The whole pulse train for the heating cycle on a single nib, with all the aforementioned controls included, is depicted in FIG. 27A and the sequence of bit streams in FIG. 27B as an illustration.

Comparison with and Improvement over Conventional Structures

The pattern of conductive path of the printhead structure of the invention is shown in FIG. 11. As a comparison, the prior art center-tap structure of FIG. 1 has a density of conductive pattern twice that of the pattern of FIG. 11. Thus, the structure of the printhead of FIG. 11 is advantageous by reducing both the technical difficulty and manufacturing cost due to lower density requirement of the conductive pattern. It also has a better potential in the development of a high resolution thermal head. Comparing the structure of FIG. 11 with alternated conductive systems, with diodes (FIG. 2) or without diodes (FIG. 4), the densities of conductor path are the same, i.e., one conductive lead per nib element. The main improvement of the structure of FIG. 11 is that the leakage currents existing in alternated conductive systems, with diodes (FIG. 2) or without diodes (FIG. 4), can be completely eliminated.

Figure 28:
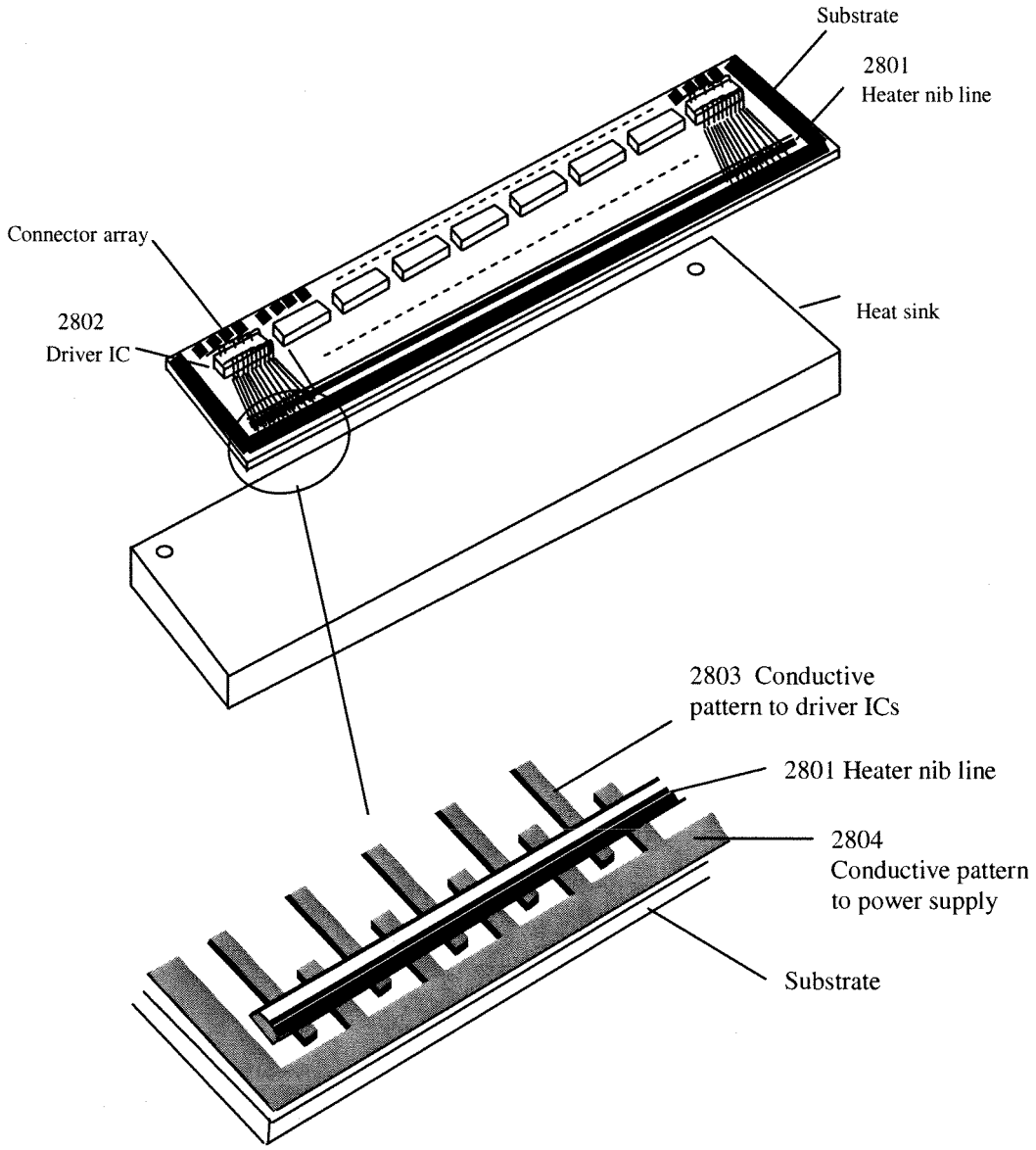
Fig. 28 (PRIOR ART)
FIG. 28 is the layout of a thick film printhead assembly of a traditional prior art center-tap structure.
Figure 29:
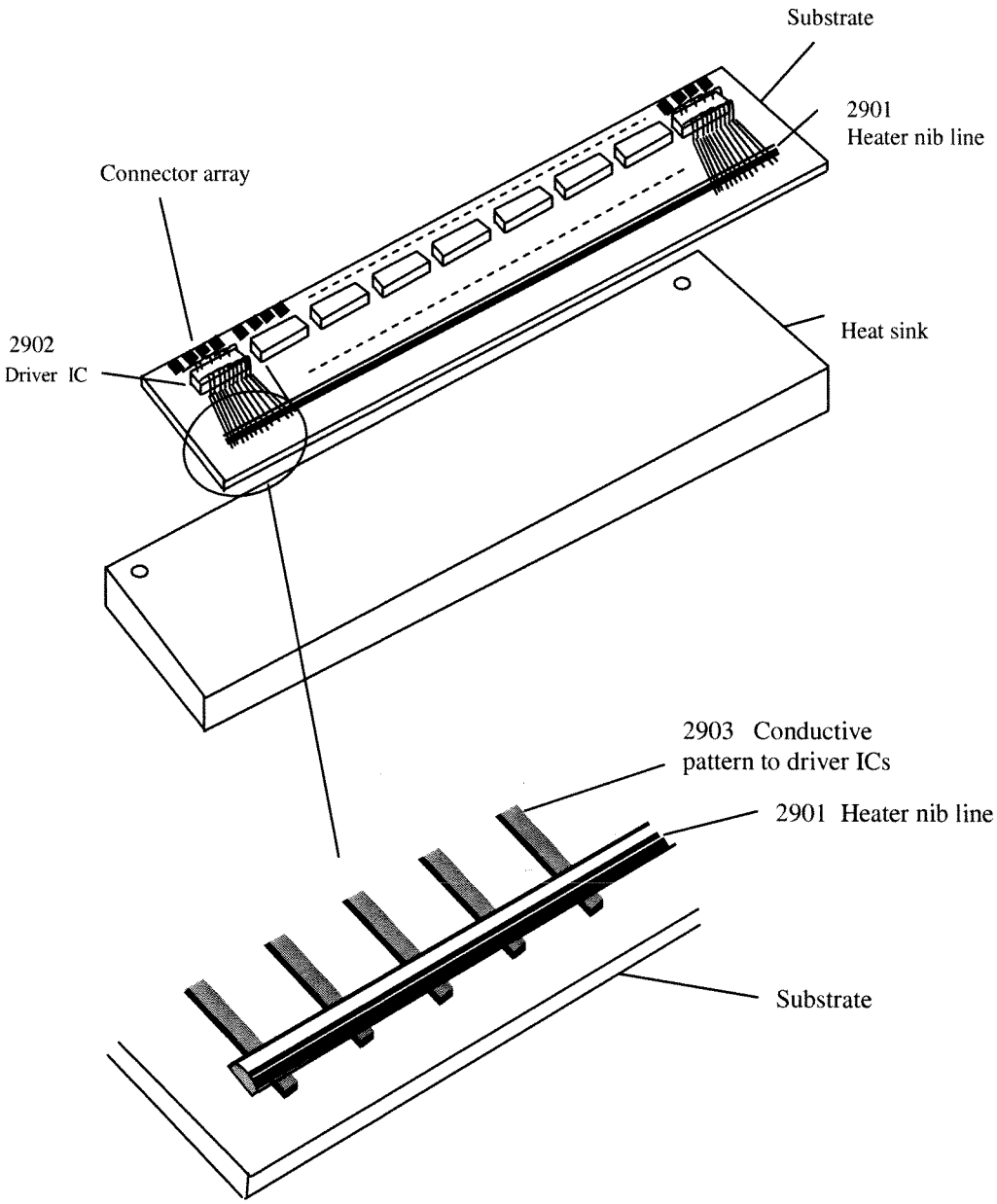
FIG. 29 is the layout of a thick film printhead assembly of the proposed structure where all the conductive leads are on the same side of the nib line.

Another advantage of the structure of FIG. 11 is the location and physical placement of conductive leads. Illustrating the comparison, a printhead assembly of a traditional, center-tap structure (FIG. 1) is shown in FIG. 28, where conductive leads 2804 connected to the power supply are usually in the opposite side of the nib line 2801 to those leads 2803 connected to the driver ICs 2802. In the new structure of FIG. 29, all the conductive leads 2903 are on the same side of the nib line 2901, because they are all connected to the driver ICs 2902. This feature of all conductive leads being on the same side is advantageous in terms of minimizing space and material costs, and thus is more suitable for manufacturing edge or near-edge type printheads.

The design of a thermal head should take into account the voltage drop due to the resistance on the power supply conductive pattern. Consider a thermal head of 8 dot/mm (~200 dpi) and 20 cm in length as an example. The specification for the heater element resistance is 2,000Ω. The total number of heater elements is 8×200=1,600 and, in the printing situation when all the nibs are turned on, the equivalent resistance is 2,000/1,600=1.25Ω since it's like a circuit with 1,600 resistors connected in parallel. To reduce the voltage drop on the power supply path, the resistance on the power supply conductive pattern should be minimized to be much smaller than 1.25Ω. Due to this requirement, on a conventional thermal printhead assembly such as the traditional center-tap structure shown in FIG. 28, a thick film gold conductive pattern of low specific resistance is used on the top half portion as the power supply conductive plane 2804. By comparison, in the structure according to the invention (FIG. 29) since a power supply and GND are included in the driver IC connections, the voltage drop outside the nibs becomes much lower and does not pose a demanding restriction in the design.

Extension to High-resolution or Thin-film Thermal Head Applications

One design approach of a high-resolution thermal head is to use dual nib lines, one for even-numbered nibs and a second one for odd-numbered nibs, mounted on the printhead assembly. For example, two 600-dpi nib lines with diode-less alternated conductive lead system have been used in the past to form a 1200-dpi printhead as described in detail in a 2009 published paper (Toyosawa et al., "Development of dual-line wide-format 1200-dpi thermal printhead," JIST, vol. 53, no. 9 September/October 2009). Since the structure of this invention (FIG. 11) is of the same conductive path density as the printhead structure using diode-less alternated conductive lead system, it can also easily adopt the same dual-line approach to the design of a high-resolution thermal head.

The general-purpose driver IC 2601 (FIG. 26) of the invention can be configured to have the built-in XOR function working, if required, by setting XEN=1. When the XOR function is to be implemented in the raster data processing FPGA or the microprocessor in the main processor system, the built-in XOR function can be turned off by grounding XEN, i.e., XEN=0. In the case of XEN=0, by using just one output of the SPDT switch, essentially it behaves as a traditional driver IC 0601 (FIG. 6), i.e., it just shifts through the input data and, with latch and strobe signals, controls the SPST switch outputs. Therefore, the general-purpose driver IC 2601 in FIG. 26 of the invention can also be used in conventional thick-film printhead structures as well as for thin-film printheads.

What is claimed is:

1. A thick film thermal head structure comprising, a heater nib line of resistive material, a plurality of contact points spaced along said nib line with spaces between said contact points defining nibs (R1, R2 . . . ), each said contact point electrically connected to a separate conductive lead (1202, 1203) which extends outwardly in the same direction away from one side of said nib line, each said nib (R1, R2) having no other electrical lead connected thereto between said conductive leads (1202, 1203), a ground lead (Gnd) and a voltage lead ($V_{hd}$), and, Single-Pole-Double-Throw (SPDT) switches (1204, 1205), each of said switches having a single pole connected to one of said conductive leads (1202, 1203) and having a double pole switch arm which can be controlled to connect to either said ground lead (Gnd) or said voltage lead ($V_{hd}$), and further comprising, a control circuit which controls said Single-Pole-Double-Throw (SPDT) switches (1204, 1205), according to an exclusive-OR (XOR) logic function (1301), to connect each conductive lead (1202, 1203) to said ground lead (Gnd) or said voltage lead ($V_{hd}$) so that current or no current is produced through said nibs (R1, R2 . . . ) according to a desired data pattern.

2. The thermal head structure of claim 1 wherein, said control circuit is a driver Integrated Circuit (IC) (1401) including XOR gates (1403, 1404, 1405), said Single-Pole-Double-Throw (SPDT) switches (1402), latch and strobe gates (1406, 1407), and a data shift register (1408), wherein, said control circuit is arranged and designed to read a desired data pattern into a SerialIn port and control said SPDT switches for connecting said conductive leads (1202, 1203) to either said ground lead (Gnd) or said voltage lead ($V_{hd}$).

3. The thermal head structure of claim 1 wherein, said control circuit is a Field Programmable Gate Array (FPGA, 1801) which is programmed to split a full scanline of raster data into multiple bit streams of shorter length, to perform said XOR functions (1301, 1302) on said bit streams concurrently to form multiple logic processed bit streams, and to apply said multiple logic processed bit streams to SerialIn ports of a plurality driver ICs (1701) for data shifting, latching and strobing.

4. The thermal head structure of claim 1 wherein, said control circuit includes software in a main processing system (MPS), which performs table lookup operations (2001, 2101, 2202*a*, 2202*b*, 2301) implementing said XOR functions (1301, 1302) to convert a raster data pattern into switch data (S1 S2 . . . ), and a Field Programmable Gate Array (FPGA, 2401) for data splitting, so that the split switch data are applied concurrently to a SerialIn port of a plurality of driver ICs (1701) for data shifting, latching and strobing.

5. The thermal head structure of claim 1 wherein, said control circuit is physically arranged in an asymmetric layout due to the physical placement of a plurality of driver ICs (1401 or 1701) on the thermal head assembly.

6. The thermal head structure of claim 1 wherein, said control circuit is a driver Integrated Circuit (IC, 2601) comprising an array of said Single-Pole-Double-Throw (SPDT) switches (2610), an array of exclusive-OR (XOR) gates (2603, 2605) which are designed and arranged to be enabled or disabled by an external signal XEN (XOR Enable) via an array of control gates (2602, 2604), an array of data latching gates (2608) and strobing gates (2609), and a data shift register (2611), comprising D-type flip-flops (2606, 2607), which is arranged and designed to receive data input at a Serialln port, shift data out bit by bit to said array of XOR gates (2603, 2605) and pass the data through said latching gate (2608) and said strobing gate (2609) to the control input end of said array of SPDT switches (2610) so that the appropriate switching action is produced.

7. The thermal head structure of claim 6 wherein, said driver Integrated Circuit (2601) is arranged with an external input XEN set to 1 to have the XOR function enabled, so that, when a desired data pattern is read into said Serialln port, said conductive leads (1202, 1203) wired to the output ends (SW1, SW2 . . . ) of said driver IC (2601) are connected to either said ground lead (Gnd) or said voltage lead ($V_{hd}$) according to the desired data pattern.

8. The thermal head structure of claim 6 wherein, said driver Integrated Circuit (2601) is arranged with an external input XEN (XOR Enable) connected to said ground lead to have the XOR function disabled, the thermal head structure further comprising, a Field Programmable Gate Array (FPGA, 1801) which is programmed to split a full scanline of raster data into multiple bit streams of shorter length, to perform said XOR functions (1301, 1302) on said bit streams concurrently to form multiple logic processed bit streams, and to apply said multiple logic processed bit streams to the Serialln (S-In) port of driver ICs (2601 with XEN=0) for data shifting, latching and strobing.

9. The thermal head structure of claim 7 wherein, said control circuit comprises a driver Integrated Circuit (2601) with the on-chip XOR function disabled by connecting XEN to ground, an algorithm running on a main processing system (MPS), and a Field Programmable Gate Array (FPGA) (2401), said algorithm in said main processing system (MPS) arranged to perform table lookup operations (2001, 2101, 2202*a*, 2202*b*, 2301) implementing said XOR functions (1301, 1302), and said FPGA (2401) is programmed to split a full scanline of logic processed bit stream into multiple bit streams of shorter length, and to apply said multiple bit streams to the Serialln port of driver ICs (2601) with XEN=0 for data shifting, latching and strobing.

10. The thermal head structure of claim 6 wherein, said control circuit is physically arranged in an asymmetric layout due to the physical placement of the driver Integrated Circuits (2601) on the thermal head assembly.

11. The thermal head structure of claim 6 wherein, said driver Integrated Circuit (2601) is designed and arranged such that the XOR function is disabled when the external input XEN=0 by connecting XEN to ground, and only the ground switch output GND(H) is used, whereby the driver IC acts as a traditional driver IC (0601) for use in conventional printhead structures as Well as for thin-film printheads.

* * * * *